US008814397B2

(12) United States Patent
Breidenassel et al.

(10) Patent No.: US 8,814,397 B2
(45) Date of Patent: Aug. 26, 2014

(54) COOLING ELEMENT FOR A LIGHTING DEVICE

(75) Inventors: Nicole Breidenassel, Regensburg (DE); Guenter Hoetzl, Regensburg (DE); Fabian Reingruber, München (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 164 days.

(21) Appl. No.: 13/148,490

(22) PCT Filed: Feb. 8, 2010

(86) PCT No.: PCT/EP2010/051512

§ 371 (c)(1), (2), (4) Date: Sep. 29, 2011

(87) PCT Pub. No.: WO2010/089397

PCT Pub. Date: Aug. 12, 2010

(65) Prior Publication Data

US 2012/0014098 A1 Jan. 19, 2012

(30) Foreign Application Priority Data

Feb. 9, 2009 (DE) ..... 10 2009 008 096

(51) Int. Cl.
*F21V 29/00* (2006.01)

(52) U.S. Cl.
USPC ..... 362/373; 362/294

(58) Field of Classification Search
USPC ..... 362/373, 294, 345
See application file for complete search history.

(56) References Cited

U.S. PATENT DOCUMENTS

| | | | | |
|---|---|---|---|---|
| 7,871,184 | B2 | 1/2011 | Peng | |
| 2004/0032751 | A1 * | 2/2004 | Solovay et al. | 362/580 |
| 2006/0227558 | A1 | 10/2006 | Osawa et al. | |
| 2008/0037226 | A1 | 2/2008 | Shin et al. | |
| 2008/0049399 | A1 | 2/2008 | Lu et al. | |
| 2008/0149305 | A1 | 6/2008 | Chen | |

FOREIGN PATENT DOCUMENTS

| | | | |
|---|---|---|---|
| CN | 201190980 | Y | 2/2009 |
| DE | 202007003679 | U1 | 6/2007 |
| DE | 202008006325 | U1 | 8/2008 |
| DE | 102007017900 | A1 | 10/2008 |
| DE | 102007037820 | A1 | 2/2009 |
| DE | 202009000699 | U1 | 4/2009 |
| DE | 102009052930 | A1 | 3/2011 |
| JP | 2006313731 | A | 11/2006 |
| JP | 3134602 | U | 8/2007 |
| JP | 3135391 | U | 9/2007 |
| JP | 3143410 | U | 7/2008 |
| WO | 2006020535 | A2 | 2/2006 |
| WO | 2007146566 | A2 | 12/2007 |
| WO | 2008086665 | A1 | 7/2008 |
| WO | 2008125191 | A1 | 10/2008 |
| WO | 2009021695 | A1 | 2/2009 |

OTHER PUBLICATIONS

English language abstract of DE 10 2009 052 930 A1.
English machine translation of DE 20 2007 003 679 U1.

(Continued)

*Primary Examiner* — Joseph L Williams

(57) ABSTRACT

A cooling element for a lighting device having a plurality of cooling fins, wherein adjacent cooling fins delimit a cooling fin intermediate space with at least one air duct for connecting at least two cooling fin intermediate spaces.

16 Claims, 24 Drawing Sheets

(56) References Cited

OTHER PUBLICATIONS

English machine translation of DE 20 2009 000 699 U1.
English language abstract of JP 2006313731 A dated Nov. 16, 2006.
English language abstract for CN 201190980 dated Feb. 4, 2009.
English language abstract of DE 10 2009 052 930 A1, Mar. 24, 2011.
English machine translation of DE 20 2007 003 679 U1, Jun. 21, 2007.
English machine translation of DE 20 2009 000 699 U1, Apr. 30, 2009.

* cited by examiner (Schnitt A-A)

COOLING ELEMENT FOR A LIGHTING DEVICE

RELATED APPLICATIONS

The present application is a national stage entry according to 35 U.S.C. §371 of PCT application No.: PCT/EP2010/051512 filed on Feb. 8, 2010, which claims priority from German application No.: 10 2009 008 096.1 filed on Feb. 9, 2009.

TECHNICAL FIELD

Various embodiments relate to a cooling element for a lighting device, and a lighting device having such cooling element.

BACKGROUND

One of the problems with regard to lamps employing light emitting diode (LED) technology is the high temperature which is produced by the LEDs, because the operating life and the efficiency of the LEDs are dependent on the temperature. Some LED lamps are therefore provided with a cooling element thermally coupled to the LEDs. The majority of cooling fins are implemented as cooling fins of the lamellar type which run on the outside along the lamp body. A "chimney effect" is produced along these lamellae, which achieves a better heat dissipation than a heat dissipation by means of simple convection or radiation because the air flows past the lamellae at an increased speed. This effect only occurs, however, when the lamp is in a 'perpendicular' position whereby the cooling fins are orientated perpendicularly. In a 'horizontal' position, whereby the cooling fins are orientated horizontally the lamp therefore becomes significantly warmer than in the perpendicular position.

SUMMARY

Various embodiments provide a cooling element for a lighting device which is less position-dependent and which may avoid the drawbacks described above.

The object of the present invention is to provide a cooling element for a lighting device, having a cooling facility which is less position-dependent.

The cooling element has a plurality of cooling fins, whereby in each case adjacent cooling fins delimit a fin intermediate space, and has at least one air duct for connecting at least two cooling fin intermediate spaces. By this means, a chimney effect can also be produced for the situation where the cooling element or its cooling fins is or are orientated horizontally. This is because the air heated in a cooling fin intermediate space can now be discharged through the air duct and onward through a further cooling fin intermediate space situated higher. As a result of the cooling element design, air flows can therefore flow transversely through the lamp. This is advantageous for example with regard to a deployment at floor level and in the vicinity of a room ceiling because a vertical air flow is produced there by the air exchange.

Advantageously, the cooling fins or the cooling fin intermediate spaces can at least in sections adjoin an internally situated hollow space or free space which contains or forms the at least one air duct. By this means, it is possible to form a particularly simple air duct.

Advantageously, the cooling fins can extend at least in sections along a longitudinal axis of the cooling element and around the hollow space to the outside, which makes possible a particularly rectilinear air duct and thus fast air flows.

Advantageously, the cooling fins can be arranged angularly symmetrically around a longitudinal axis of the cooling element around the hollow space. By this means, given a horizontal position of the cooling element, the chimney effect is essentially independent of the orientation of the cooling element around its longitudinal axis.

Advantageously, at least some cooling fins can have free edges at least in sections laterally on both sides. By this means, particularly large air passage openings are achieved, which supports a chimney effect. With regard to cooling fins extending outwards, the edges which are free laterally on both sides are understood to be the (laterally or with respect to the longitudinal axis) outer edge and the inner edge.

Advantageously, at least some cooling fins can have free edges at least in sections on three sides. This can in particular mean that these cooling fins stand free at least in sections and are connected only on one side to another part of the cooling element, for example a carrier plate or carrier disk. By this means, it is possible to achieve a cooling element which is particularly pervious to air and lightweight. In particular, the free-standing cooling fins or cooling fin sections should not contact one another.

It is expedient if with regard to the cooling element the disk-shaped part has at least one through-opening from the space in front of the disk-shaped part to the space behind the disk-shaped part between the cooling fins. By this means, it is possible for an air exchange to also take place between these two spaces, which is advantageous in particular with regard to a perpendicular installation position, in other words when the longitudinal axis is orientated perpendicularly, because the lateral exchange, as takes place in the case of a horizontally orientated cooling element, is then rendered more difficult.

Advantageously, the cooling element is connected to a housing for a drive electronics module. By this means, it is possible to achieve a particularly compact construction for an illumination device.

Advantageously, the housing for the drive electronics module can be mounted at a rear end of the cooling fins. By this means, it is possible to achieve maximum thermal decoupling between an at least one front-mounted light source and the control electronics. In particular, the cable duct can be surrounded by spaced cooling fins, whereby the cooling fins can surround the cable for example radially in cross-section.

Advantageously, the cooling element can be connected to the housing by means of a cable duct running through the hollow space. By this means, a wiring which is simple to implement can be made possible between at least one light source and the control electronics.

Advantageously, the cable duct can consist of a light guiding material. This can be optically coupled to at least one light source. By this means, it is possible to achieve a particularly high-quality appearance and an emission into the rear space behind the disk-shaped part of the cooling element.

Effective cooling of the drive electronics module is made possible by the housing for the drive electronics module having at least one cooling fin.

Advantageously, at least one cooling fin of the housing for the drive electronics module is arranged between two cooling fins of the cooling element. This results in a streamlined arrangement whereby both the drive electronics module and also the light source to be cooled by the cooling element are cooled particularly effectively.

The cooling fins can advantageously be lamellar shaped cooling fins.

The lighting device has at least one such cooling element.

Advantageously, the cooling element can be thermally coupled to at least one semiconductor light source. In principle it is however also possible to use the cooling element with other light sources. The type of the semiconductor light source is in principle not restricted. The semiconductor light source can have one or more semiconductor emitters, in particular light emitting diodes (LEDs). The semiconductor emitter or emitters can be packaged individually ('individual LED' for example), or a plurality of semiconductor emitters can also be accommodated on a common substrate ("submount"), for example by equipping a substrate made of AlN with LED chips. The electrical connection of the semiconductor emitters to the submount is advantageously effected by means of chip-level connection types, such as bonding (wire bonding, flip chip bonding) etc., whereas the submount and the individual LED are advantageously electrically contacted by means of conventional connection types such as soldering to the carrier plate. In principle, one or more submounts can be mounted on the carrier plate or one of the rigid carrier regions. If a plurality of semiconductor emitters is present, these can emit in the same color, for example white, which makes possible a simple scalability of the brightness. The semiconductor emitters can however at least in part also exhibit a different emission color, for example red (R), green (G), blue (B), amber (A) and/or white (W). By this means, it is where applicable possible to tune an emission color of the light source, and any desired color point can be set. In particular, it may be preferred if semiconductor emitters having different emission colors are able to produce a white mixed light. Instead of or in addition to inorganic light emitting diodes, for example based on InGaN or AlInGaP, organic LEDs (OLEDs) can in general also be used. In general, other semiconductor light sources such as laser diodes can also be used.

The cooling element can be used to particular advantage with a lighting device which is implemented as a retrofit lamp, in particular as a replacement for an incandescent lamp or fluorescent lamp.

Advantageously, the housing for the drive electronics module has a cross-section which reduces towards the front, preferably continuously. This makes possible a streamlined design of the drive housing which is simple to manufacture. This applies in particular to an approximately onion-shaped drive housing.

In an advantageous development, the housing for the drive electronics module merges continuously into a cable duct, which results in a streamlined design of the lighting device which is simple to manufacture.

Advantageously, the cooling fin intermediate spaces, in other words the openings between two cooling fins, have an approximately square cross-sectional area. This has proved to be particularly advantageous for the cooling because in this situation an advantageous compromise can be achieved between flow resistance and free surfaces.

BRIEF DESCRIPTION OF THE DRAWINGS

In the drawings, like reference characters generally refer to same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
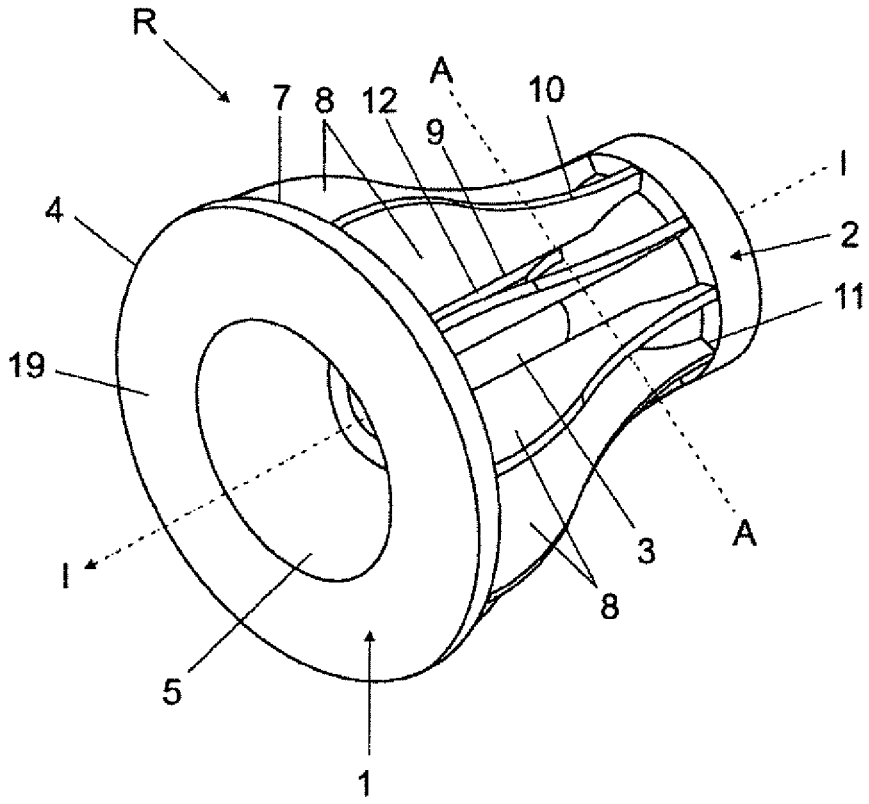
FIG. 1 shows an oblique view of parts of a lighting device having a cooling element according to a first embodiment.
Figure 2:
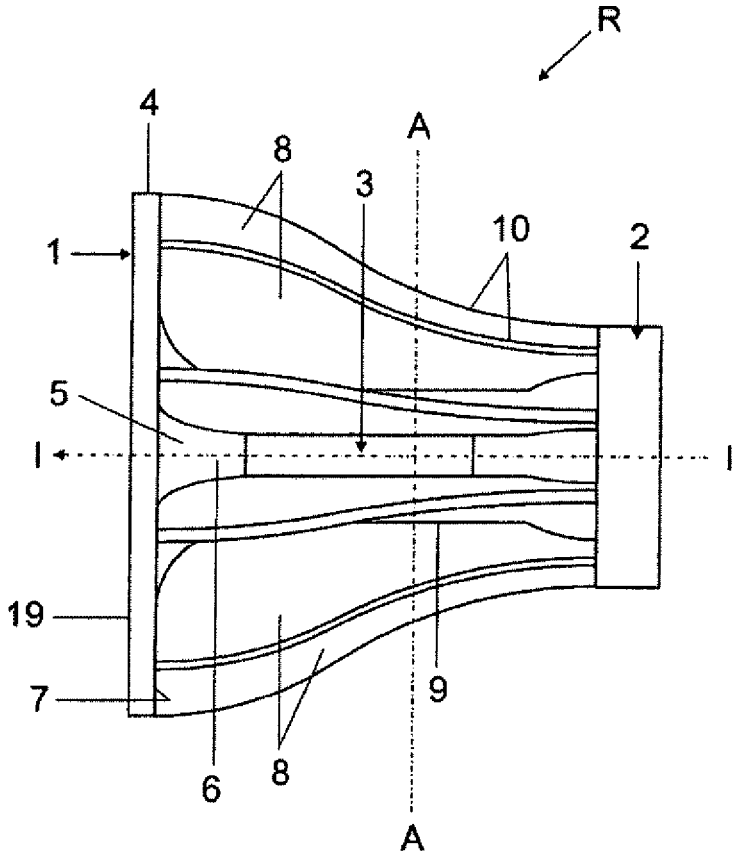
FIG. 2 shows a side view of the parts shown in FIG. 1 of the lighting device according to the first embodiment.

FIG. 1 shows an oblique view and FIG. 2 shows a side view of parts of a lighting device R having a cooling element 1, a housing 2 for a drive electronics module and a cable duct 3, whereby the cable duct 3 connects an interior space of the housing 2 to the cooling element 1. The cooling element 1 has a front disk-shaped part 4 which has a concentric, cup-like recess 5 extending backwards. The cup-like recess 5 has at its base a concentrically arranged nozzle-like opening 6 extending backwards. Cooling fins 8 in the form of lamellar shaped cooling fins attach perpendicularly to the rear side 7 of the disk 4. The cooling fins 8 extend backwards in the direction of the longitudinal axis I of the cooling element 1 and angularly symmetrically and rectilinearly radially thereto. The cooling fins 8 are connected to the disk 4 over their entire radial extent (without the recess 5) in order to enable an effective thermal conduction between the disk 4 and the cooling fins 8. The light source (not illustrated) can be mounted directly or indirectly (for example by way of a submount and/or a printed circuit board) on a front side 19 of the disk 4, including the recess 5, and in particular emit forwards (in the direction of the longitudinal axis I).

In the backward direction, the (laterally) inner margin or the inner edge 9 of the respective cooling fin 8 remains rectilinear and parallel to the longitudinal axis I while the (laterally) outer margin 10 tapers inwards (towards the longitudinal axis I); the cross-sectional area of the cooling fins 8 thereby reduces in the backward direction (opposite the direction of the longitudinal axis I). By this means, it is possible in particular to achieve a shape of an associated lamp R which is suitable as a retrofit lamp for replacement of an incandescent lamp. The cooling fins 8 are thus mounted only by their front side with respect to the cooling element 1, namely on the disk 4, and otherwise protrude freely into the space (in other words with their laterally inner edge 9, their laterally outer edge 10 and their rear edge 11). By this means, they or cooling fin intermediate spaces 13 (see FIG. 3) delimited in each case by adjacent cooling fins 8 surround a common, concentric hollow space 12. Through the provision of the hollow space 12 and as a result of the fact that the hollow space 12 is laterally (perpendicular to the longitudinal axis I) open to the outside, the cooling element 1 is pervious to air flows in the center. In the horizontal position of the cooling element 1 the air flows can be generated by the warm cooling fins 8 which heat the air in their vicinity and thereby cause it to rise through the hollow space 12 (chimney effect). The laterally open hollow space 12 thus prevents a buildup of warm air in the horizontal position of the cooling element 1 or of the cooling fins 8.

In the region of the back or rear edges 11, the cooling fins 8 are embedded in the housing 2 for the drive electronics module, namely in slots not illustrated here, by means of which the housing 2 is mechanically fixed on the cooling element 1. The connection between housing 2 and cooling element 1 can be permanent (for example by using adhesive or latching means) or releasable. For the purpose of cable routing between the drive electronics module (not illustrated) situated in the housing 2 and front-mounted light sources (not illustrated) which are thermally coupled to the cooling element 1, the cable duct 3 passes concentrically with the longitudinal axis I from the housing 2 through the hollow space 12 to the nozzle 6. In this situation its cross-sectional area is so small that an air flow through the hollow space 12 is not impeded. The cable duct 3 is manufactured from plastic in order to achieve weight savings and enable cost-effective production.

Figure 3:
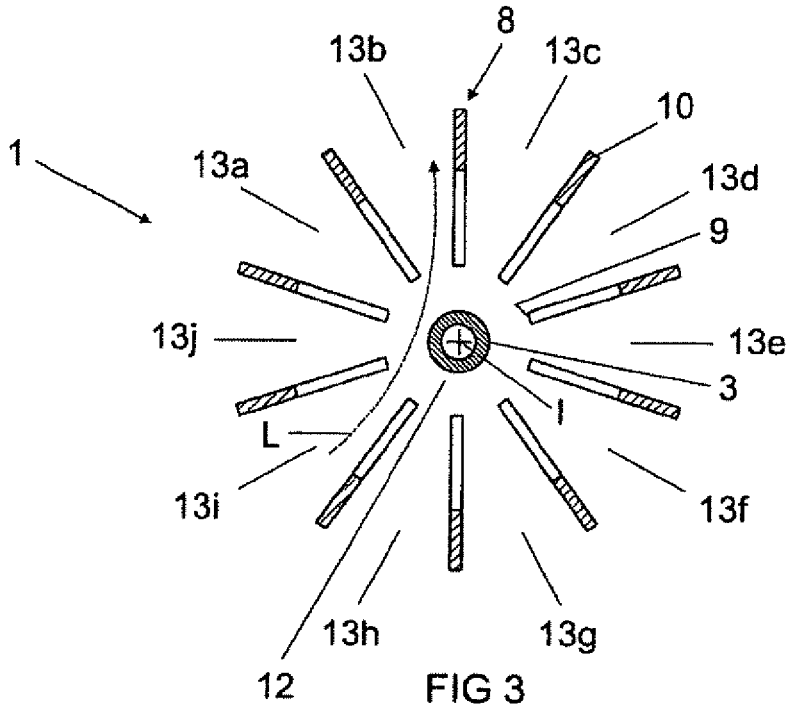
FIG. 3 shows a sectional representation along a section line A-A viewed from the rear of the lighting device according to the first embodiment.

FIG. 3 shows a section through the cooling element 1 and the cable duct 3 from FIG. 1 and FIG. 2 along the section line A-A viewed from the rear. The flat cooling fins 8 are orientated radially and angularly symmetrically in cross-section with respect to the longitudinal axis I. Each of the cooling fins 8 is equally spaced from the longitudinal axis. Each two adjacent cooling fins 8 delimit a respective cooling fin intermediate space 13 or 13*a* to 13*j*. As a result of the spacing of the cooling fins 8, the hollow space 12 arranged concentrically around the longitudinal axis I is formed, which opens towards each of the cooling fin intermediate spaces 13. When the cooling element 1 heats up and with it the cooling fins 8, as a result of thermal radiation or convection the air in the cooling fin intermediate spaces 13 is heated. With regard to the cooling fin intermediate spaces 13*a*-13*e*, 13*j* opening on the outside to the side and upwards, without the hollow space 12 the heated air would then simply (with reference to the radial direction) rise on the outside from the respective cooling fin intermediate space 13, 13*b*, without the chimney effect however. In this case, in addition the air in the cooling fin intermediate spaces 13*f*-13*i* opening on the outside downwards would build up. By means of the hollow space 12, however, an internally situated air duct is formed between the cooling fin intermediate spaces 13 or 13*a*-13*j*. Consequently, air heated in the cooling fin intermediate spaces 13*f*-13*i* opening downwards can rise through the hollow space 12 acting as an air duct in particular into a cooling fin intermediate space 13*a*-13*d* opening upwards on the outside and flow off through the latter further to the outside. By this means, it is possible not only to avoid a heat buildup in the cooling fin intermediate spaces 13*f*-13*i* opening downwards, but a chimney effect additionally arises which causes the air to flow past cooling fins 8 at high speed, whereby heat dissipation in the cooling fin intermediate space 13*a*-13*d* opening upwards is also improved. A possible air flow between two cooling fin intermediate spaces 13*i* and 13*b* is indicated here by means of the dashed arrow L. The tube-shaped cable duct 3 arranged concentrically with respect to the longitudinal axis I is dimensioned such that it does not significantly impede the flow cross-section for the air flow between the cooling fin intermediate spaces 13.

Figure 4:
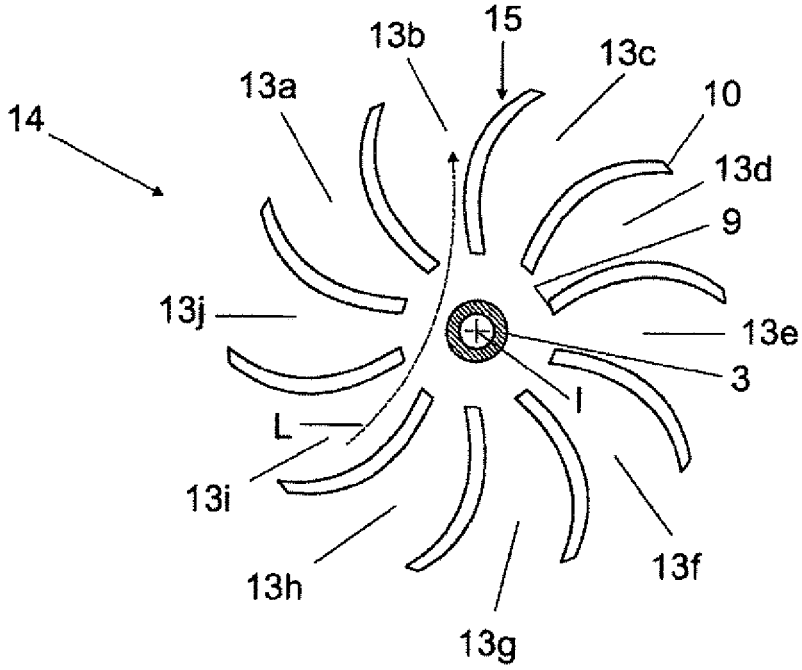
FIG. 4 shows a sectional representation viewed from the rear by analogy with the view from FIG. 3 of a lighting device according to a second embodiment.

FIG. 4 shows a section through a further cooling element 14 according to a further embodiment and a cable duct 3 in a representation analogous to FIG. 3. In cross-section the cooling element 14 now still has outward facing cooling fins 15, which however do not run rectilinearly to the outside but are curved.

Figure 5:
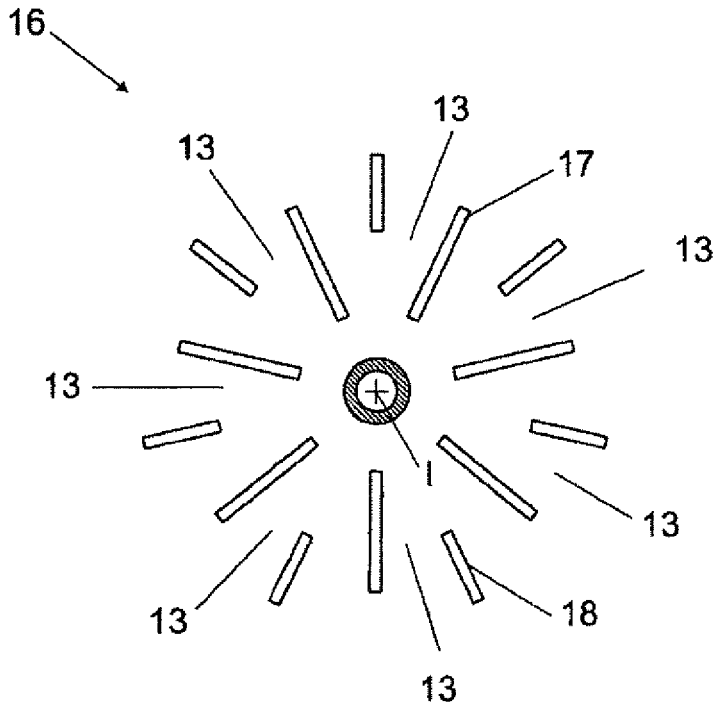
FIG. 5 shows a sectional representation viewed from the rear by analogy with the view from FIG. 3 and FIG. 4 of a lighting device according to a third embodiment.

FIG. 5 shows a section through a cooling element 16 according to a further embodiment and a cable duct 3 in a representation analogous to FIG. 3 and FIG. 4. In contrast to the embodiments described above, the cooling element 16 now has two different sets of cooling fins 17, 18, whereby the cooling fins 17, 18 of the two sets are each designed angularly symmetrically, radially rectilinearly and spaced in relation to the longitudinal axis I, but the cooling fins 18 of the second set are offset angularly and spaced further apart with respect to the cooling fins 17 of the first set, whereby the cooling fins 18 of the second set furthermore partially protrude into the associated cooling fin intermediate spaces 13 of the cooling fins 17 of the first set. The pattern of all the cooling fins 17, 18 is furthermore angularly symmetrical with respect to the longitudinal axis I. By means of this arrangement the heat transfer area of the cooling element 16 to the air is enlarged and consequently the chimney effect is increased.

Figure 6:
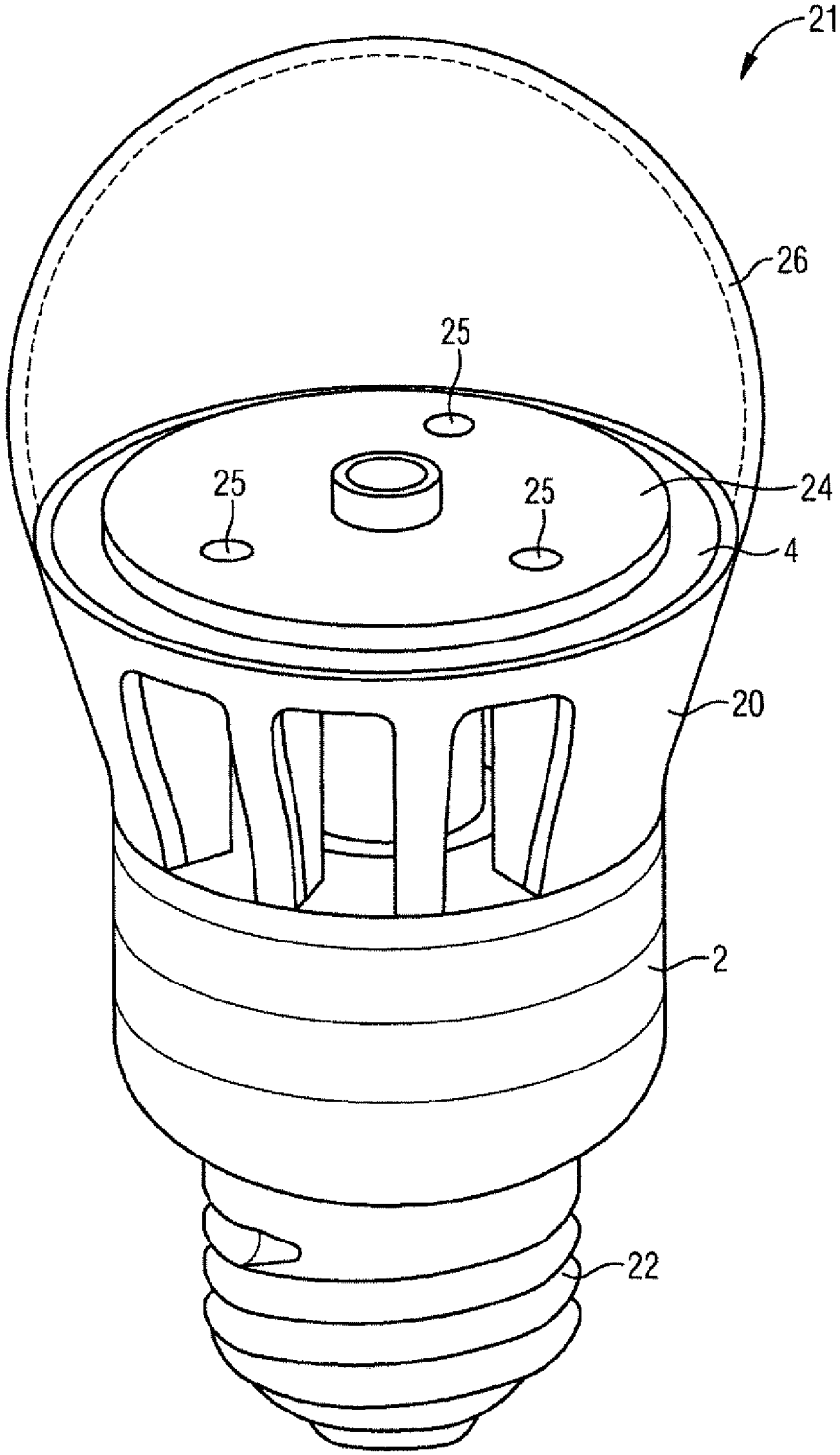
FIG. 6 shows a perspective representation of a further embodiment of the invention.

FIG. 6 shows a perspective representation of a further embodiment of the invention. Here the cooling element 20 according to the invention is installed in a so-called retrofit lamp 21, in other words a lamp which on account of its design, in particular its base 22, its electrical connection values and its external shape can be used as a replacement for a conventional incandescent lamp. Retrofit lamps have for example one of the common screw base types such as E27 or E14 or bayonet base types such as BA 15 or GU10 and are typically connected to the supply voltages (usually in a range between 12 V and 240 V) typical of incandescent or low pressure discharge lamps, even if the light sources used therein themselves have a different connection voltage.

The retrofit lamp 21 has a screw base 22, a housing 2 for a drive electronics module 23 and also a cooling element 20. On the front, disk-shaped part 4 of the cooling element 20 is a printed circuit board 24 having a light source designed as a light emitting diode (LED) 25 and also an envelope 26 which encloses the light source and thus on the one hand matches the appearance of the retrofit lamp 21 to that of a conventional incandescent lamp but also acts as a diffuser for the light emitted by the LEDs 25.

Figure 7:
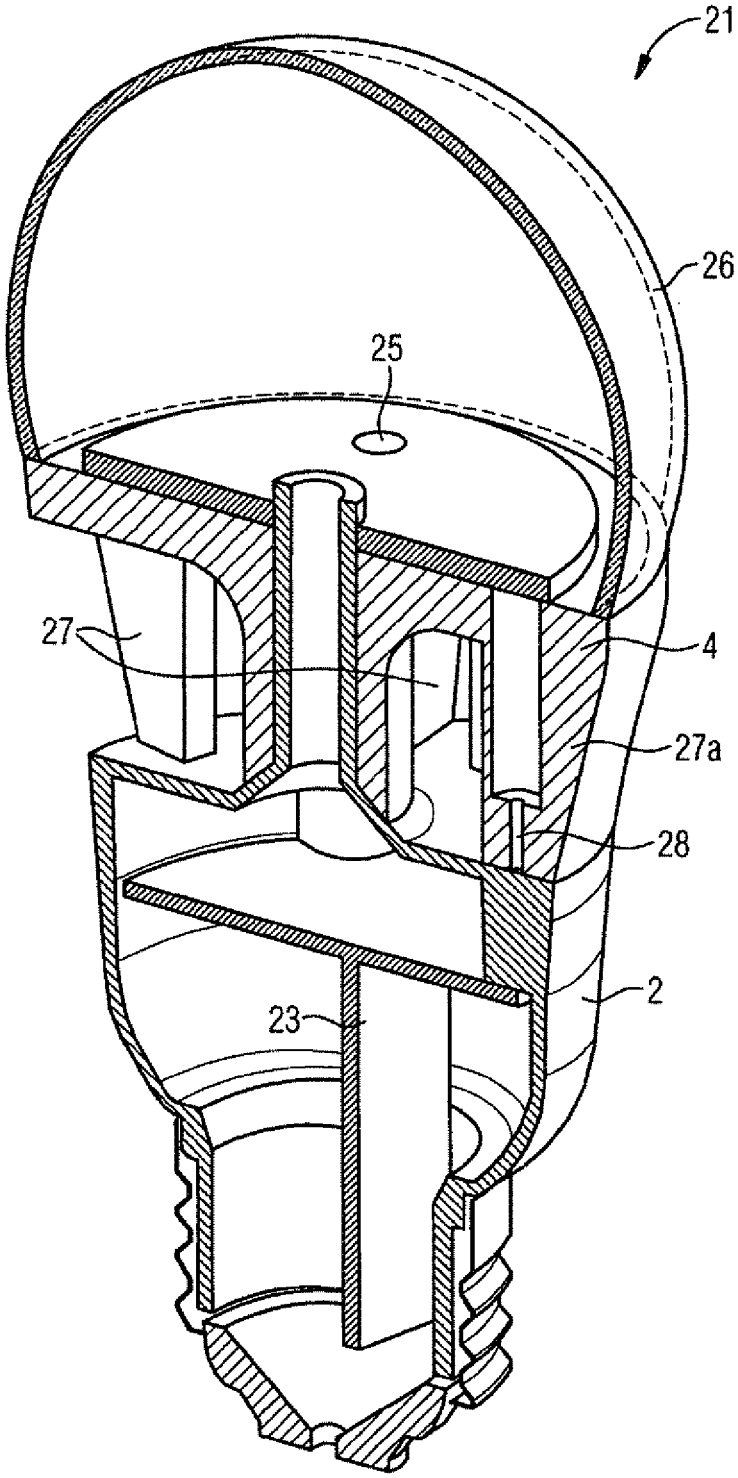
FIG. 7 shows a sectional representation of the embodiment shown in FIG. 6.

As can be seen from FIG. 7, which shows a perspective sectional view of the retrofit lamp 21 from FIG. 6, the cooling fins 27 of the cooling element 20 surround the cable duct 3. The cooling element 20 is mounted on the housing 2 by means of a screw connection, whereby the screw holes 28 are arranged in individual cooling fins 27 implemented in wider form. In this design, the thermally coupled contact area between cooling element 20 and housing 2 is small, which means that the heating of the housing 2 and thus of the drive electronics module 23 is minimized.

Figure 8:
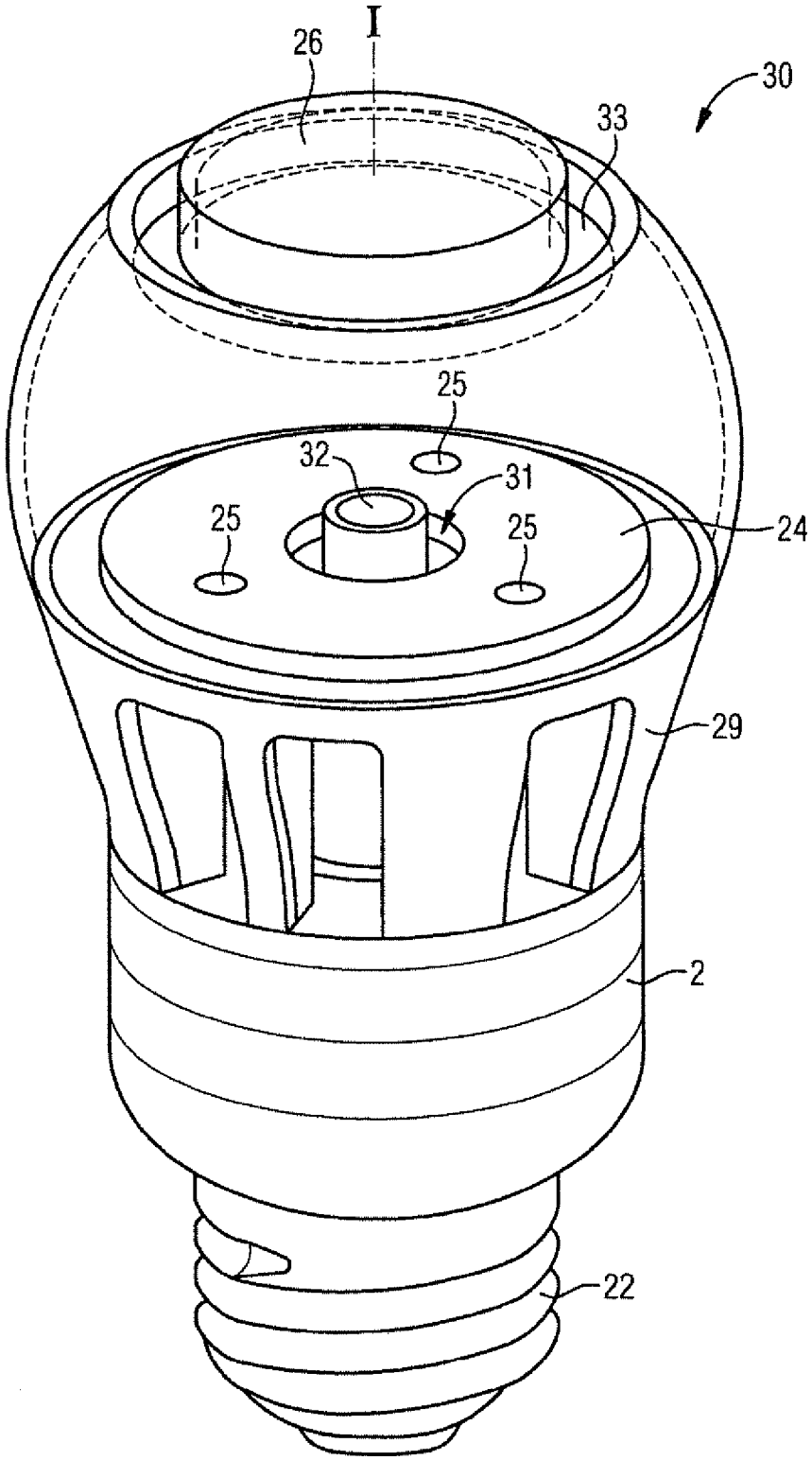
FIG. 8 shows a perspective representation of a further embodiment of the invention.
Figure 9:
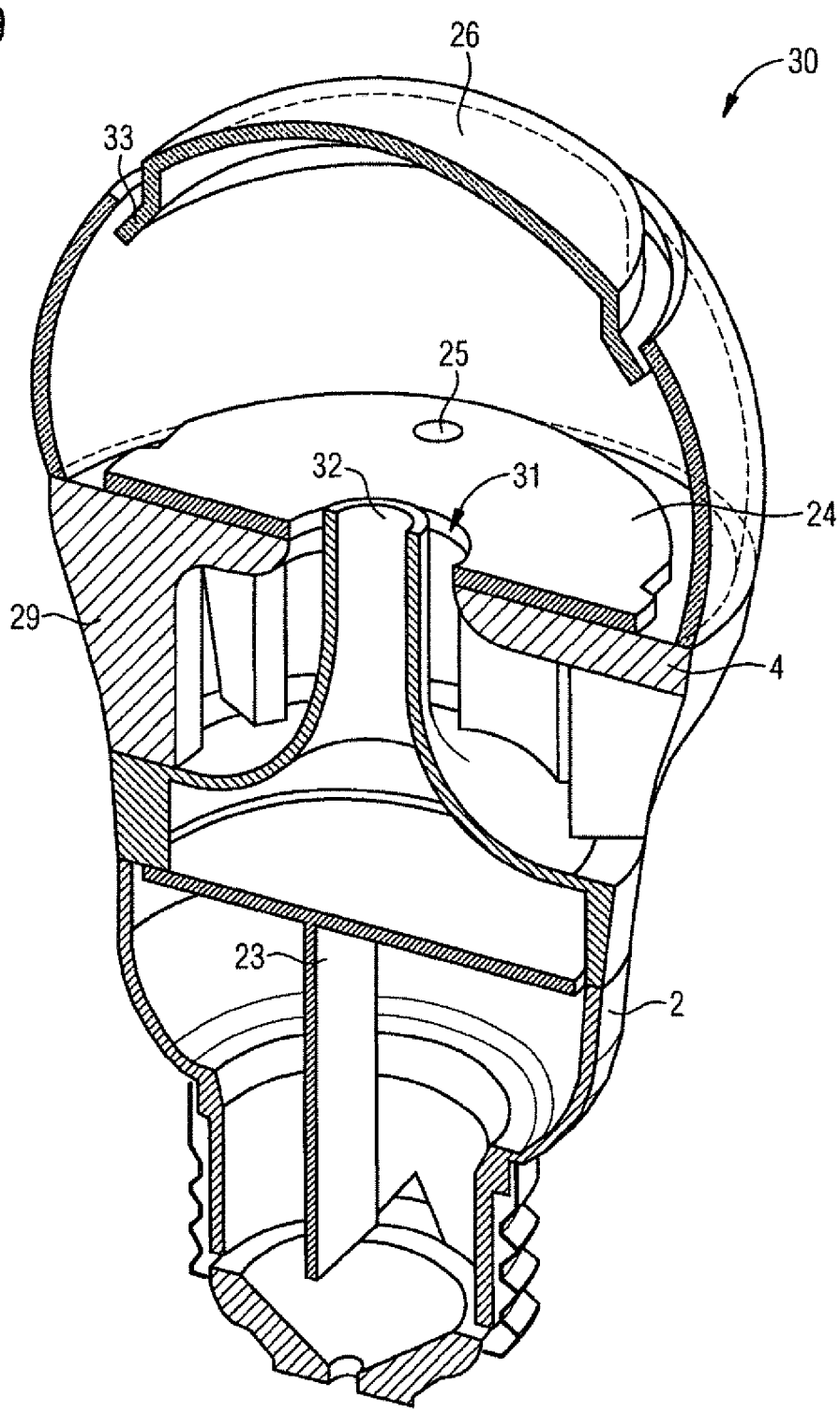
FIG. 9 shows a sectional representation of the embodiment shown in FIG. 8.

FIG. 8 shows a perspective representation of a further embodiment of the invention, wherein a cooling element 29 according to the invention is installed in a retrofit lamp 30. In analogous fashion to the previous exemplary embodiment, the retrofit lamp 30 comprises a base 22, a housing 2, a cooling element 29 and a plate 24 holding LEDs 25 which are enclosed by an envelope 26. In the present exemplary embodiment, instead of an elongated cable duct 3 only a through-opening 31 is provided, into which a cable duct 32 formed onto the housing 2 is inserted. The cable duct 32 has a smaller diameter than the through-opening 31. This enables an air exchange between the space situated behind the disk-shaped part 4 of the cooling element 29 and the space situated in front of the disk-shaped part 4 of the cooling element 29 beneath the envelope 26. The envelope 26 furthermore has one or more ventilation openings 33 which enable an air exchange with the surrounding area. So if the retrofit lamp 30 is operated in a perpendicular working position, in other words as represented in FIGS. 8 and 9 or rotated by 180°, an air flow is enabled along the longitudinal axis of the lamp I with a pronounced chimney effect. For this reason the retrofit lamp 30 has optimized cooling in practically any working position.

Figure 10:
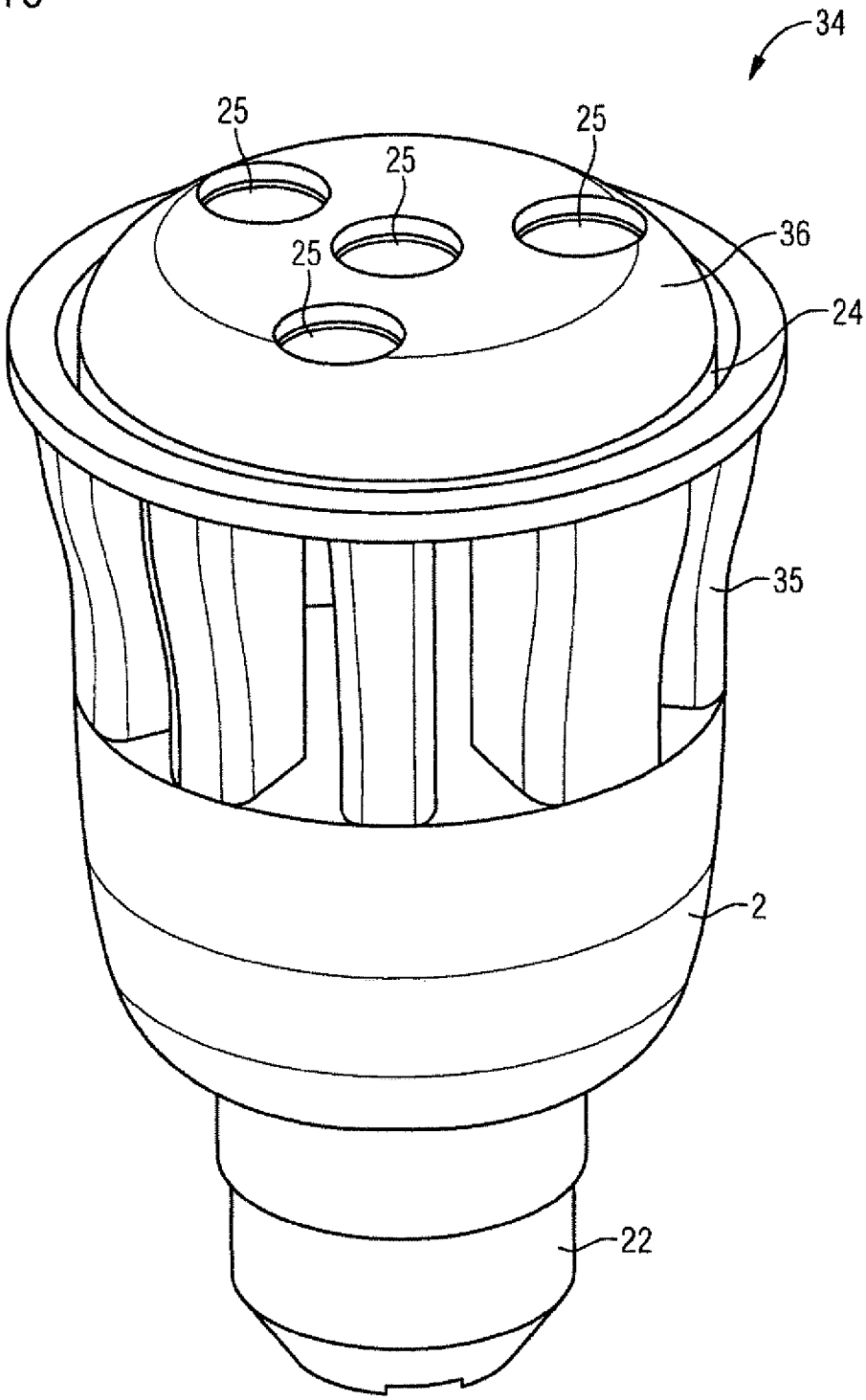
FIG. 10 shows a perspective representation of a further embodiment of the invention.

FIG. 10 shows a perspective representation of a further embodiment of a retrofit lamp 34. This retrofit lamp 34 is intended as a replacement for a conventional reflector lamp, in other words a lamp wherein a directional light emission to the front is effected by means of a reflector. The reflector lamp again comprises a base 22, a housing 2 for a drive electronics module 23, a cooling element 35 according to the invention and also a plate 24 holding LEDs 25. The plate 24 is protected against contact by means of a cover 36 which however in the present exemplary embodiment has no optical function and is perforated in the region of the LEDs 25. Other forms of embodiment are naturally conceivable however.

Figure 11:
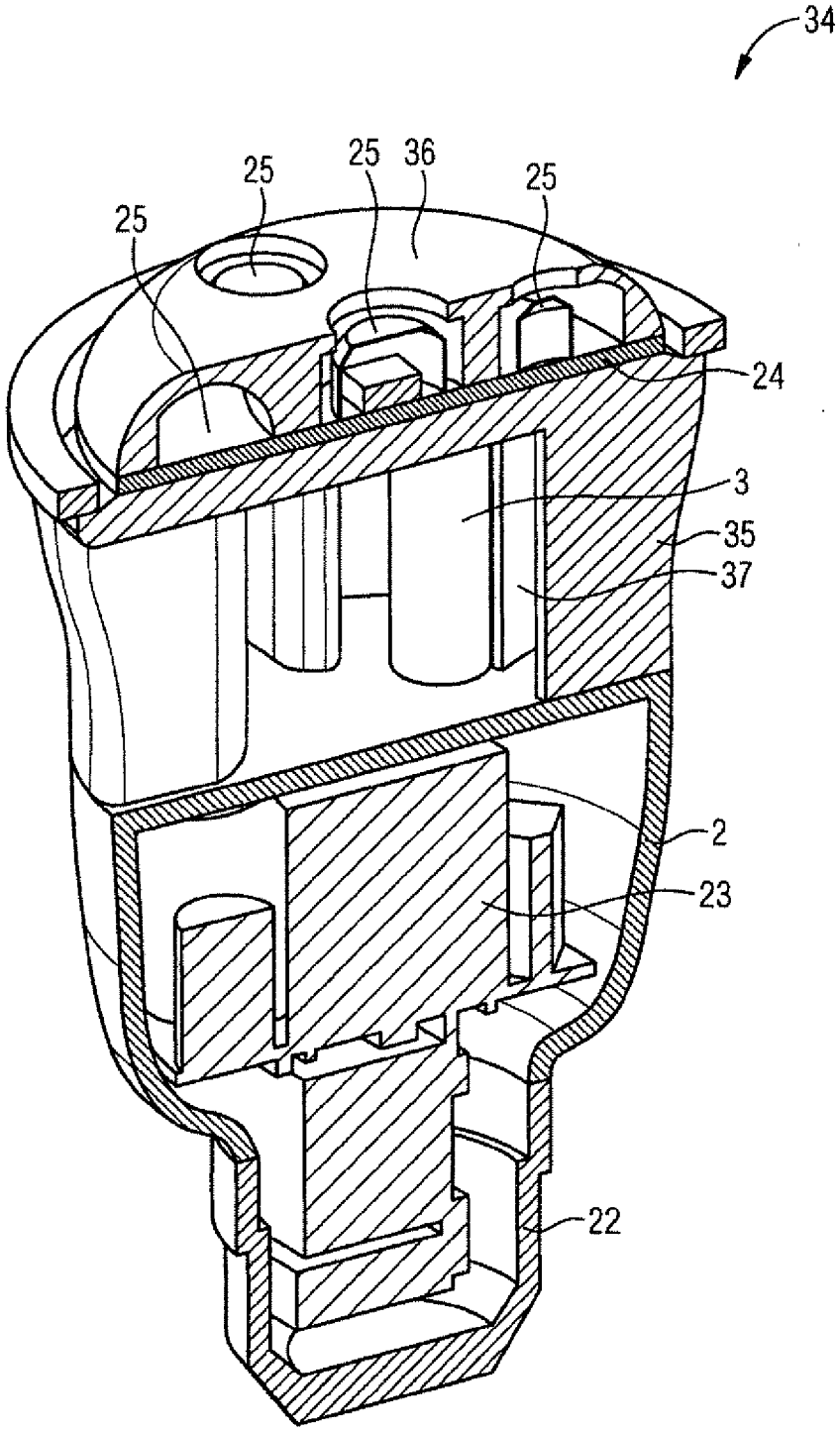
FIG. 11 shows a sectional representation of the embodiment shown in FIG. 10.

FIG. 11 is a perspective sectional view of the retrofit lamp 34. Providing the connection between drive electronics module 23 and plate 24 is a cable duct 3 which in this exemplary embodiment is arranged eccentrically. This can be advantageous for reasons of a simple wiring arrangement with regard to the drive electronics module 23 and/or the plate 24 and also for reasons of fluid mechanics, in particular if the cable duct 3 as in the present exemplary embodiment is part of a cooling fin 37.

Figure 12:
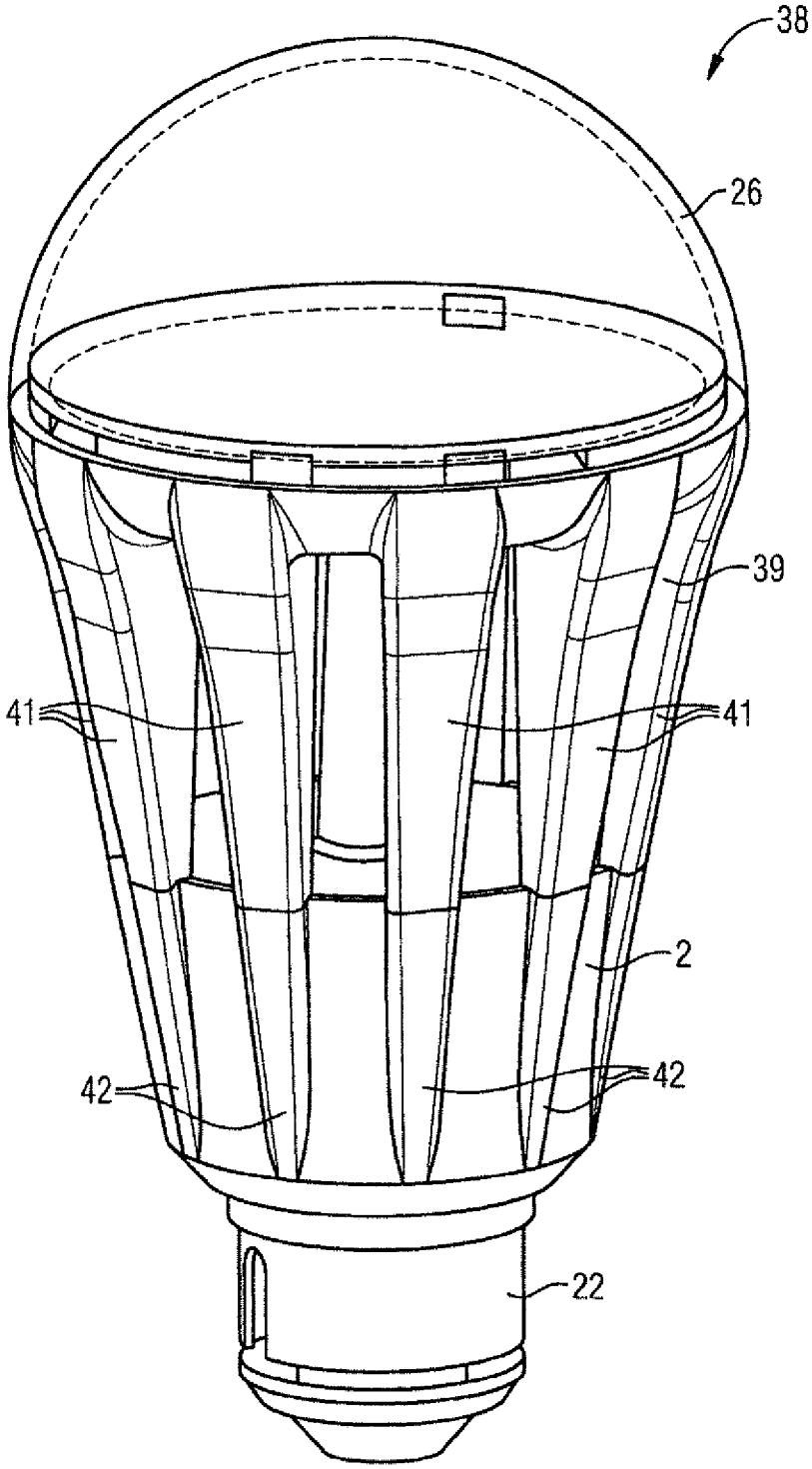
FIG. 12 shows a perspective representation of a further embodiment of the invention.

FIG. 12 shows a further exemplary embodiment of a retrofit lamp 38 according to the invention having a cooling element 39 according to the invention, wherein the cooling element 39 is arranged on a housing 2 for a drive electronics module 23 and on the cooling element 39 are mounted a plate 24 holding LEDs 25, not shown here for reasons of better illustration, and also an envelope 26. Arranged centrally inside the cooling element 39 is a cable duct 3 which connects the housing 2 to the plate 24. The housing 2 for the drive electronics module 23 has on its outside a rib structure which merges into the cooling fins 41 of the cooling element 39. The cooling fins 42 of the housing 2 enable both a cooling of the drive electronics module 23 and also a mechanical bracing of the housing 2. Furthermore, as a result of the practically seamless transition to the cooling fins 41 of the cooling element 39, the flow behavior of the cooling air and thus the cooling effect are improved.

Figure 13:
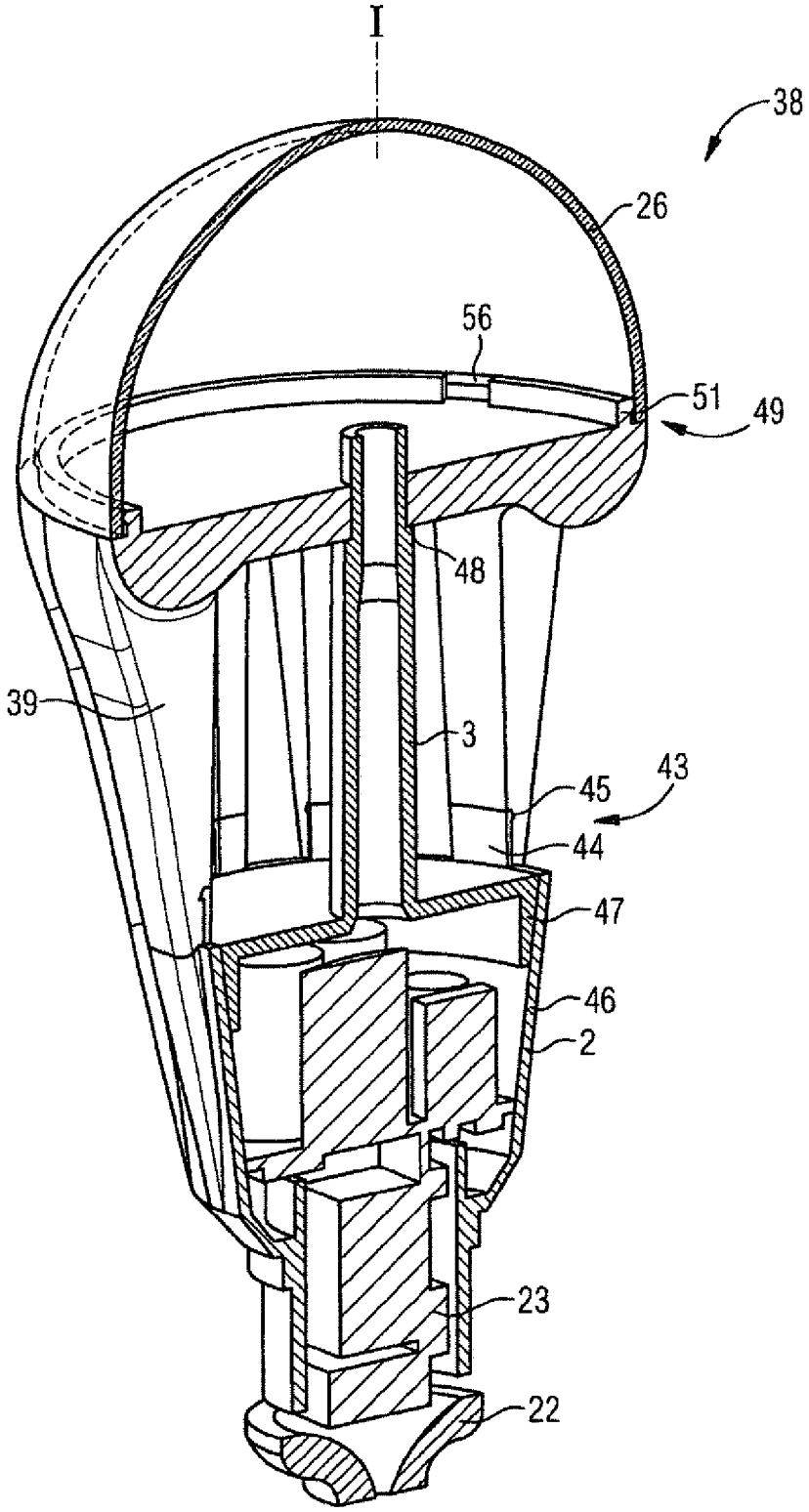
FIG. 13 shows a sectional representation of the embodiment shown in FIG. 12.

FIG. 13 is a perspective sectional view of the retrofit lamp 38 from FIG. 12. The cooling element 39 is connected to the housing 2 by way of a snap joint 43, in that the housing 2 has snap-in hooks 44 which engage in corresponding latching elements 45 in the cooling element 39. The housing 2 comprises a base body 46 and a cap 47, whereby the cap 47 and the cable duct 3 are implemented in one piece. The cap 47 is fixed by the cooling element 39 in the longitudinal direction of the lamp I by way of a ledge 48 on the cable duct 3, as a result of which the assembly of the retrofit lamp 38 is simplified. The envelope 26 is also mounted on the cooling element 39 by way of a snap joint 49 consisting of latching lugs 50 and a snap-in edge 51.

Figure 14:
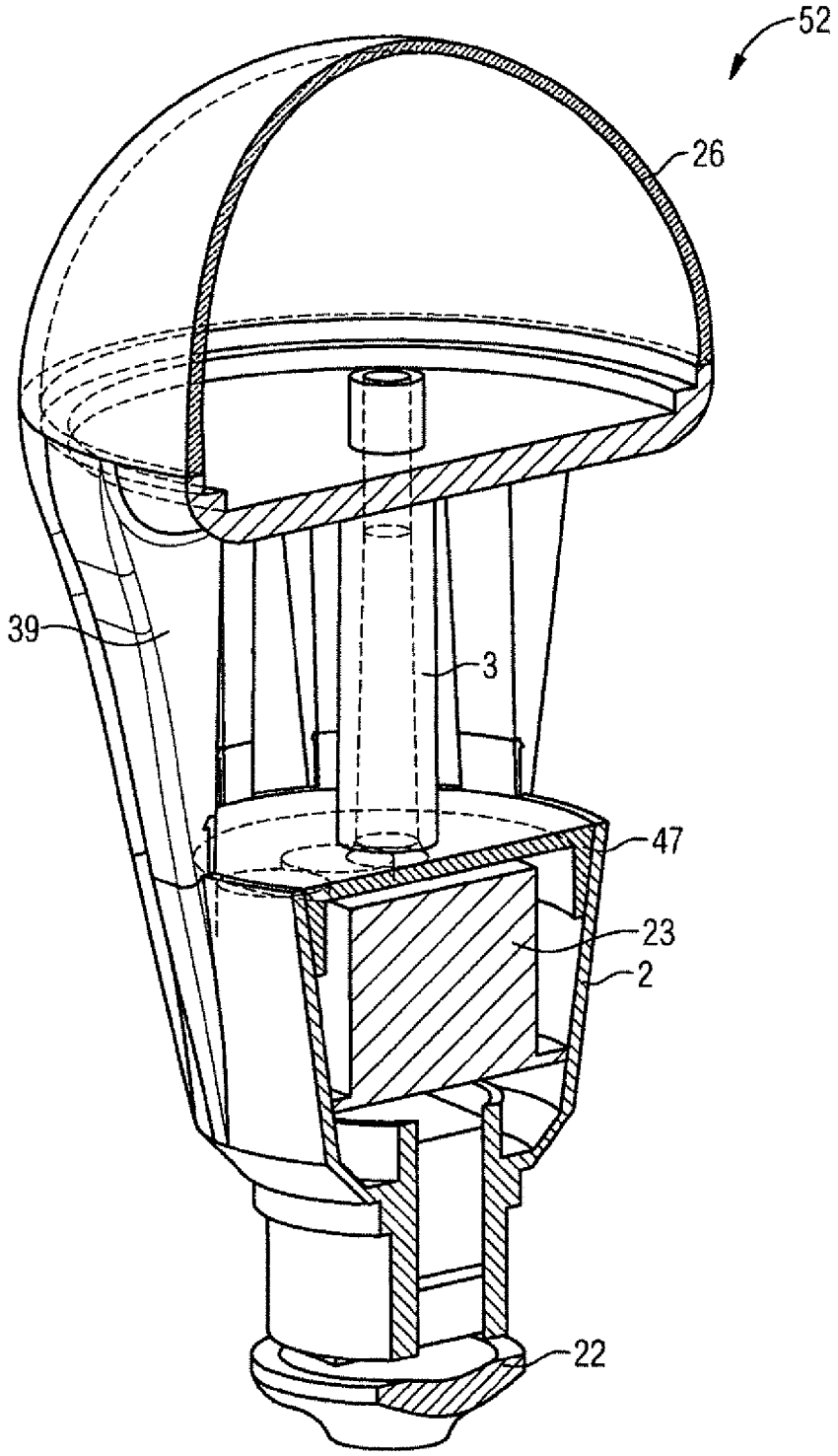
FIG. 14 shows a perspective sectional representation of a further embodiment of the invention.

FIG. 14 shows a further exemplary embodiment of a retrofit lamp 52. The retrofit lamp 52 is implemented in analogous fashion to the retrofit lamp 38 according to FIGS. 12 and 13, but here the cable duct 3 and also the cap 47 of the housing 2 is implemented from a light transmissive material. By this means, one part of the light is directed backwards from the space between cooling element 39 and envelope 26, as a result of which the illumination in the rear region of the retrofit lamp 52 is improved. The light direction function can be influenced by the selection of the material for the cable duct 3 and also by the treatment of said material, for example a reflective coating, preferably on the inside, which means that the cables are no longer visible and the light is delivered better to the outside.

Figure 15:
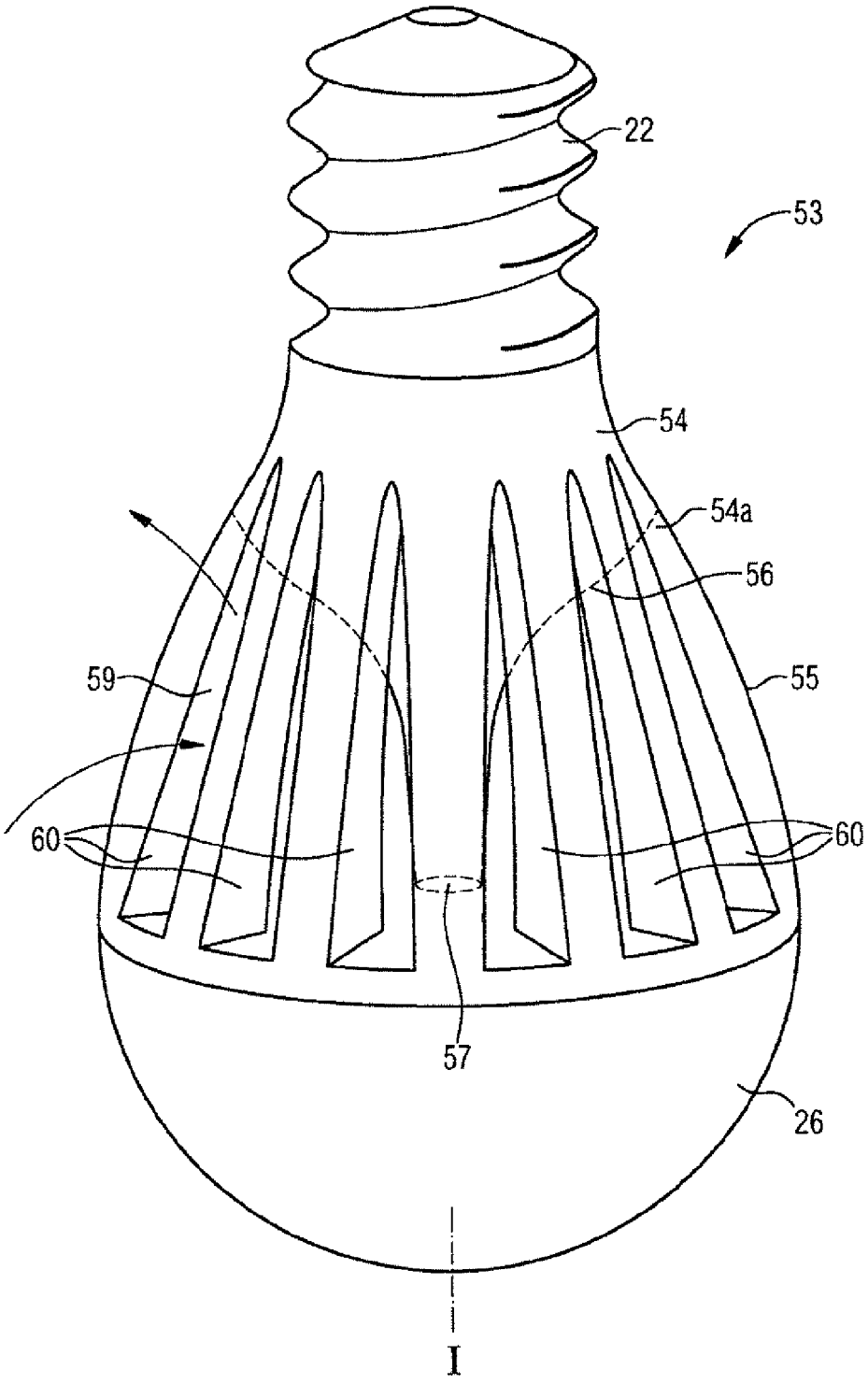
FIG. 15 shows a perspective representation of a further embodiment of the invention.

FIG. 15 shows a perspective representation of a further embodiment of a retrofit lamp 53 with base 22, housing 54, cooling element 55 and envelope 26. With regard to this embodiment, the front cover 56 of the housing 54 is designed as onion-shaped and thus merges gradually with a continuously reducing cross-section into the cable duct 57. A sharp edge at the transition from a side wall of the housing 2 to the cap 47, as in the preceding exemplary embodiments, is avoided. By this means, on the one hand a streamlined flow of the cooling air is achieved regardless of the installation position of the retrofit lamp 53 because a good cooling is achieved both with regard to horizontal positioning of the lamp axis I on account of the flow through the cooling element 55 perpendicular to the lamp axis I and also with regard to a perpendicular assembly wherein the cooling air can enter and exit unimpeded (see arrows). This applies in particular with regard to the installation position prevailing in practice and shown in FIG. 15, wherein the front side of the retrofit lamp 53 points downwards. On the other hand, given the same volume for installation of the drive electronics module 58 the margin 54*a* of the housing 54 can be arranged further to the rear with this type of construction than with a cylindrical housing 2, as a result of which the cooling fin intermediate spaces 59 on the sides between the cooling fins 60 of the cooling element 55 can be implemented as particularly large and the cooling element 55 thus yields a particularly good cooling effect.

Figure 16:
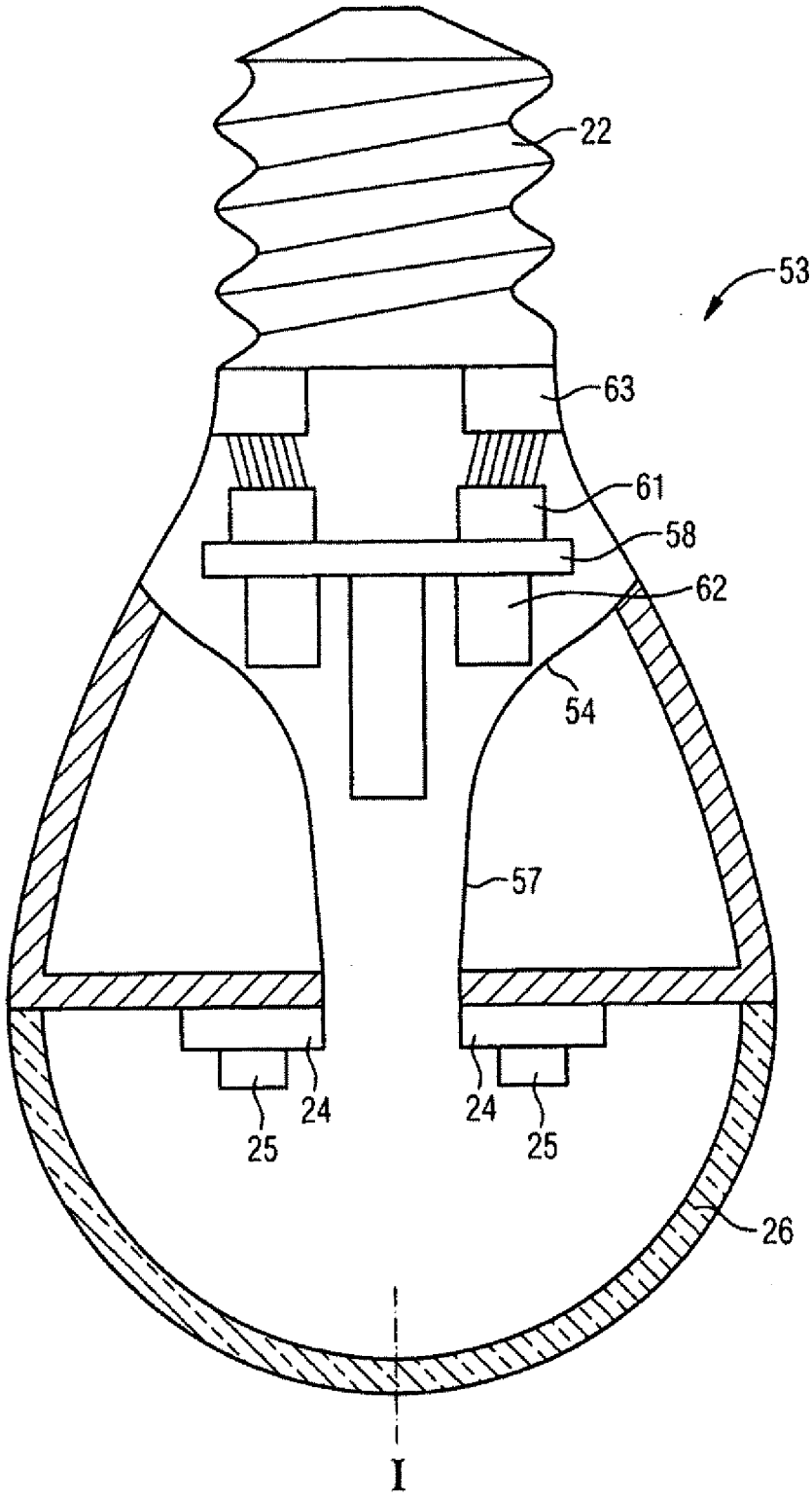
FIG. 16 shows a sectional representation of the embodiment shown in FIG. 15.

FIG. 16 shows a sectional representation of the retrofit lamp 53 shown in FIG. 15. The outer contour of the drive electronics module 58 is matched to the shape of the housing 54, whereby particularly heat-sensitive components 61 are preferably arranged in the vicinity of the base 22, while temperature-insensitive components 62 are arranged in the region of the transition to the cable duct 57 because higher temperatures occur there during operation. The heat-sensitive components 61 are moreover connected to the housing 54 in a heat-conducting manner, for example by means of a thermally conductive paste, in order to further improve the cooling of these components 61. To this end, the housing 54 is provided with projections 63.

Figure 17:
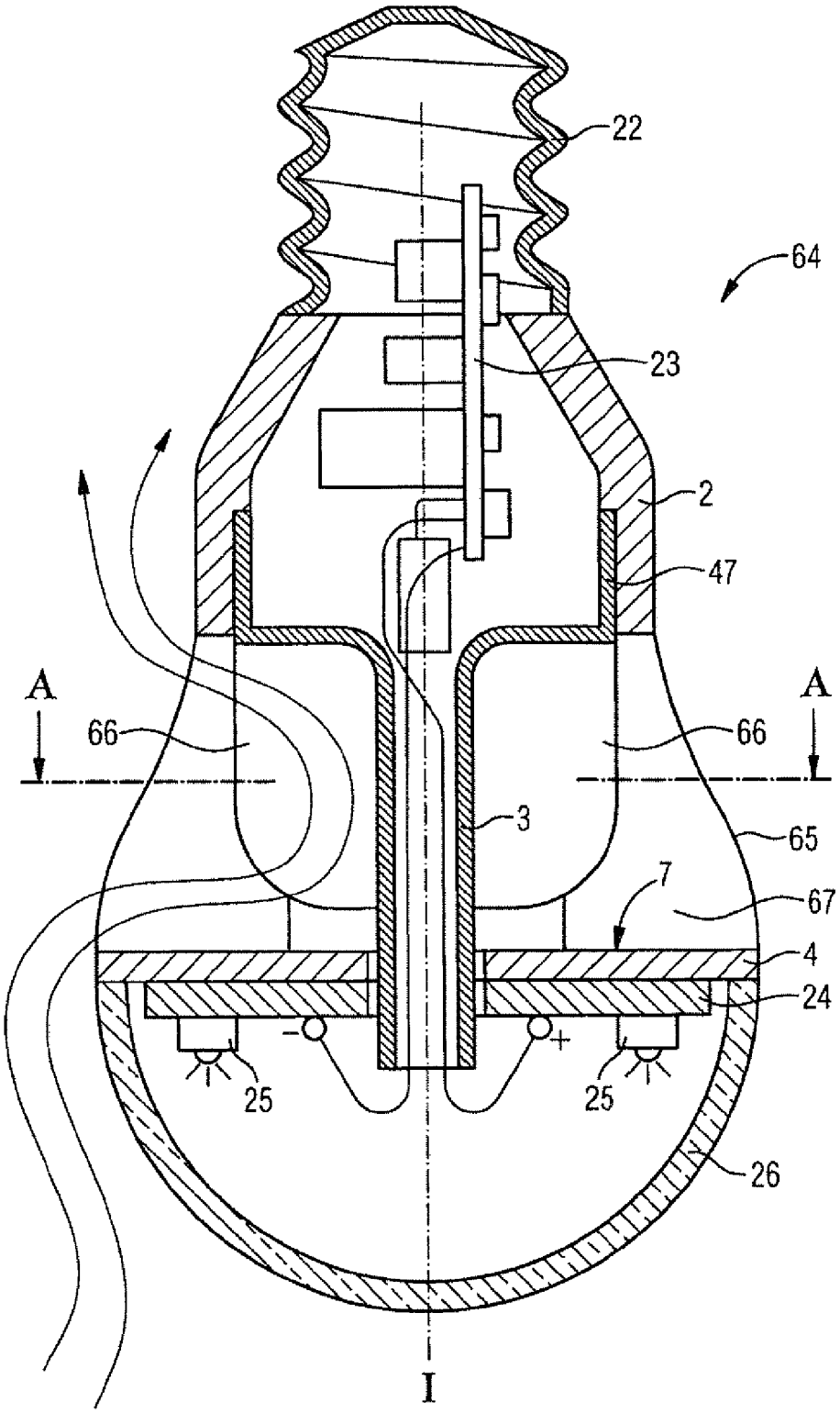
FIG. 17 shows a sectional representation of a further embodiment of the invention.
Figure 18:
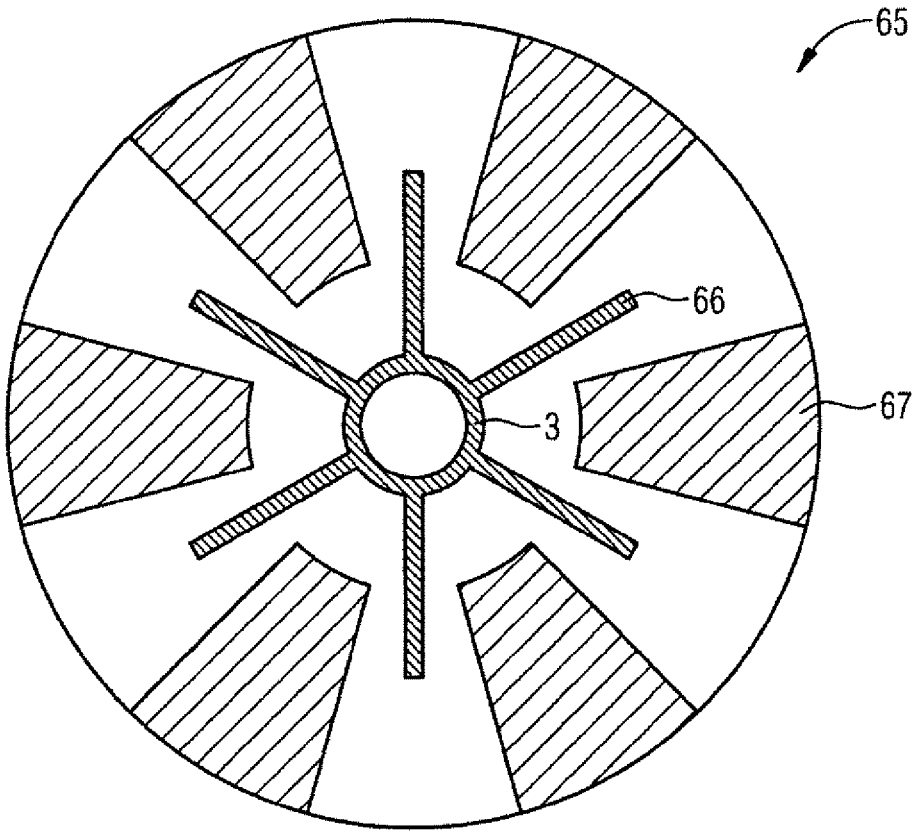
FIG. 18 shows a sectional representation along the line A-A of the embodiment of the invention shown in FIG. 17.

FIG. 17 and FIG. 18 show a sectional representation of a further retrofit lamp 64 with base 22, housing 2 for drive electronics module 23 with cap 47 and cable duct 3, cooling element 65, plate 24 holding LEDs 25 and envelope 26. The basic construction is similar to that of the retrofit lamps 21, 38, 52 from FIGS. 6, 12 and 14. In the present exemplary embodiment however, the drive electronics module 23 is also cooled by means of cooling fins 66 which are mounted on the cap 47 and the cable duct 3 or are implemented in one piece with the latter. This can be seen particularly clearly in FIG. 18 which represents a section along the line A-A in FIG. 17. The cooling fins 66 of the housing 2 are arranged alternating with the cooling fins 67 of the cooling element 65, by which means particularly favorable flow conditions result for an effective cooling of drive electronics module 23 and light sources 25. The cooling fins 66 of the housing 2 are not continued as far as the rear side 7 of the disk-shaped part 4 of the cooling element 65 but end behind the latter, which improves the ventilation and in particular the cooling of the cooling element 65. The cross-section of the cooling fins 66 of the housing 2 reduces as the distance from the housing 2 increases, which likewise improves the ventilation in the front region of the cooling element 65 and thus the cooling of the LEDs 25.

Figure 19:
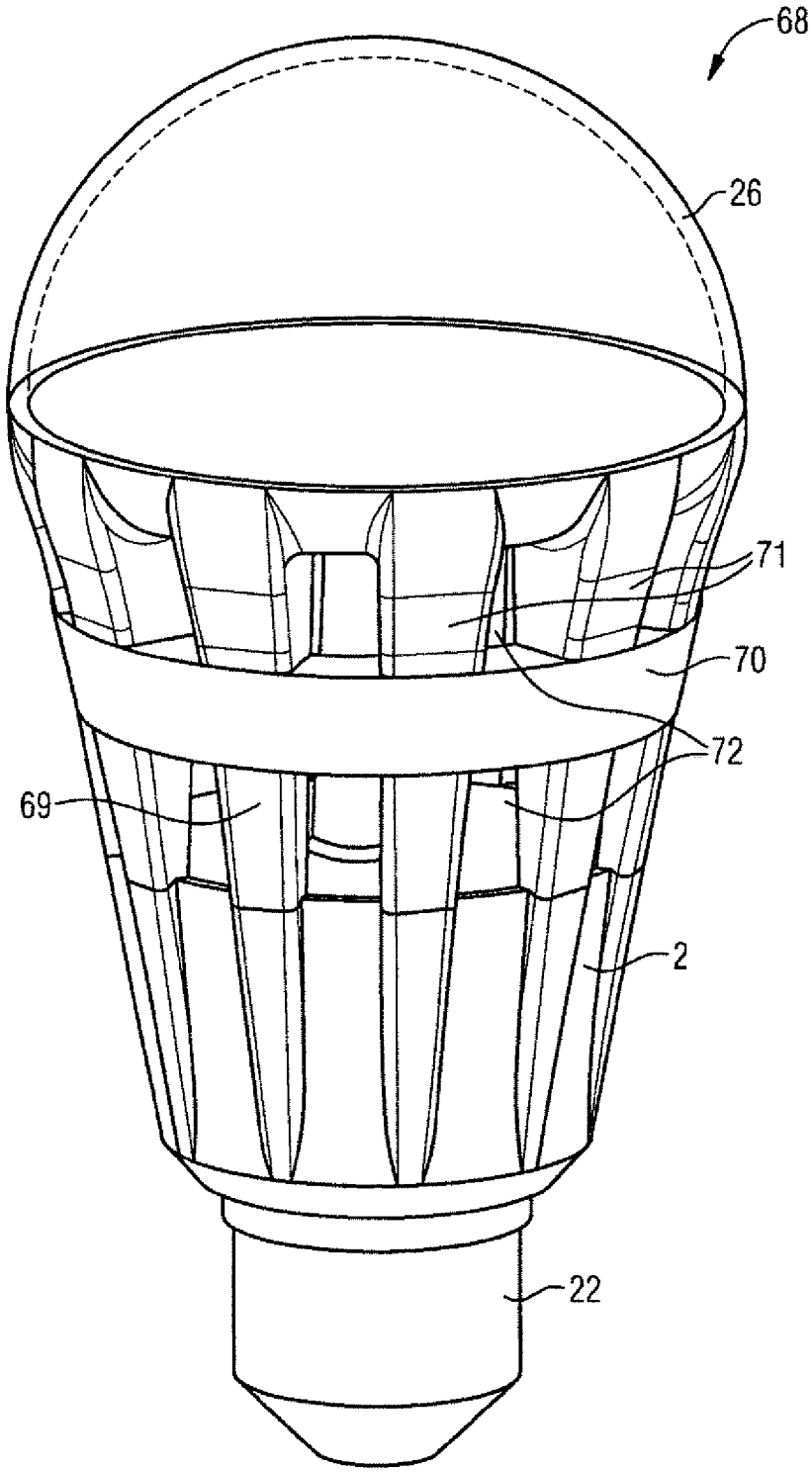
FIG. 19 shows a perspective representation of a further embodiment of the invention.

FIG. 19 shows a perspective representation of a further retrofit lamp 68. In this retrofit lamp 68, the cooling element 69 has in its central part a circumferential band 70 which connects cooling fins 71 to one another. This serves on the one hand to increase the mechanical stability of the cooling element 69, but on the other hand in particular causes an increase in the effective surface area of the cooling element 69. It has been shown that in the region of the band 70 the air flow is only very slight in the case of comparable band-free cooling elements, which means that the band 70 does not unduly disrupt the air flow but a better cooling effect is achieved as a result of the increased surface area. In particular, it has proved to be advantageous if the cooling fin intermediate spaces 72 at the sides in the cooling element 69 have an approximately square cross-sectional form.

Figure 20:
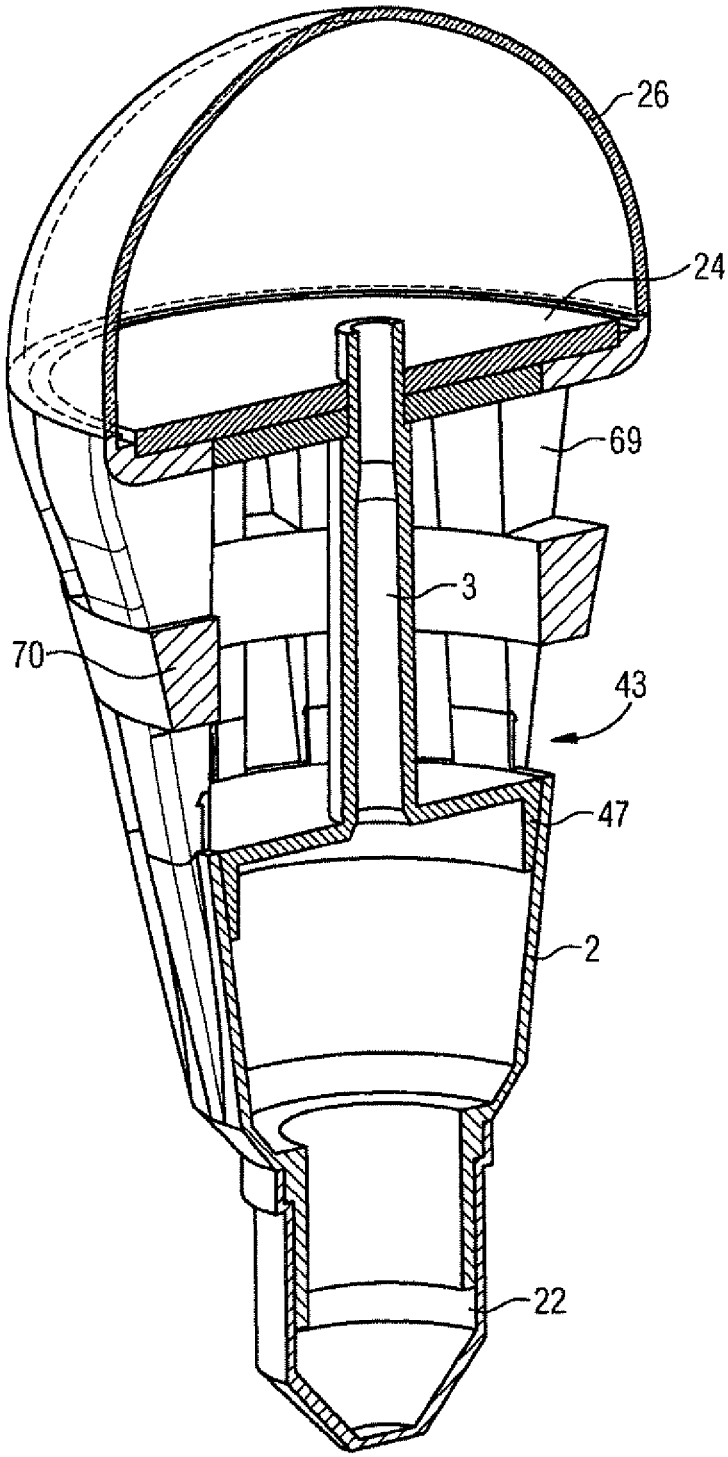
FIG. 20 shows a sectional representation of the embodiment shown in FIG. 19.

FIG. 20 shows a section through the retrofit lamp 68 which is similar in its construction to the lamp from FIGS. 12 and 13, in other words the cooling element 69 is mounted on the housing 2 by means of a snap joint 43 and holds the cap 47 by way of the cable duct 3.

Figure 21:
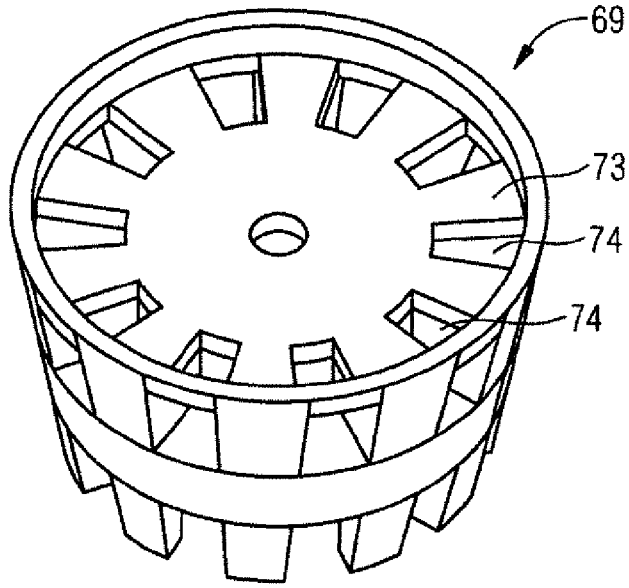
FIG. 21 shows a perspective detailed representation of a cooling element for the embodiment shown in FIG. 19.

FIG. 21 shows a perspective view of the cooling element 69 of the retrofit lamp 68 from FIGS. 19 and 20. The disk-shaped part 73 of the cooling element 69 is not solid in this exemplary embodiment but has openings 74. On the one hand these facilitate the production of the cooling element 69 in particular by using casting processes because the removal of the cooling element 69 from a mold is thus facilitated. If the diameter of the plate 24 is sufficiently small or if the plate 24 has suitable openings, an air exchange with the space between plate 24 and envelope 26 can also take place through these openings 74, with the result that the cooling of the LEDs 25 is improved. This applies in particular if the envelope 26 has ventilation openings similar to the example in FIGS. 8 and 9.

Figure 22:
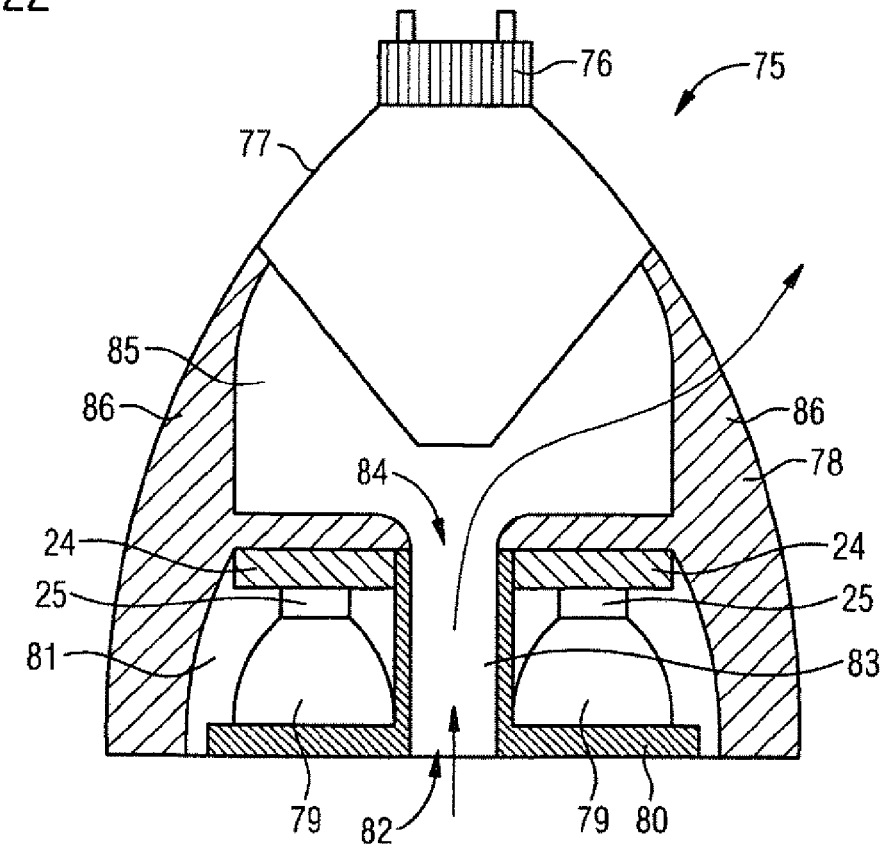
FIG. 22 shows a sectional representation of a further embodiment of the invention.
Figure 25:
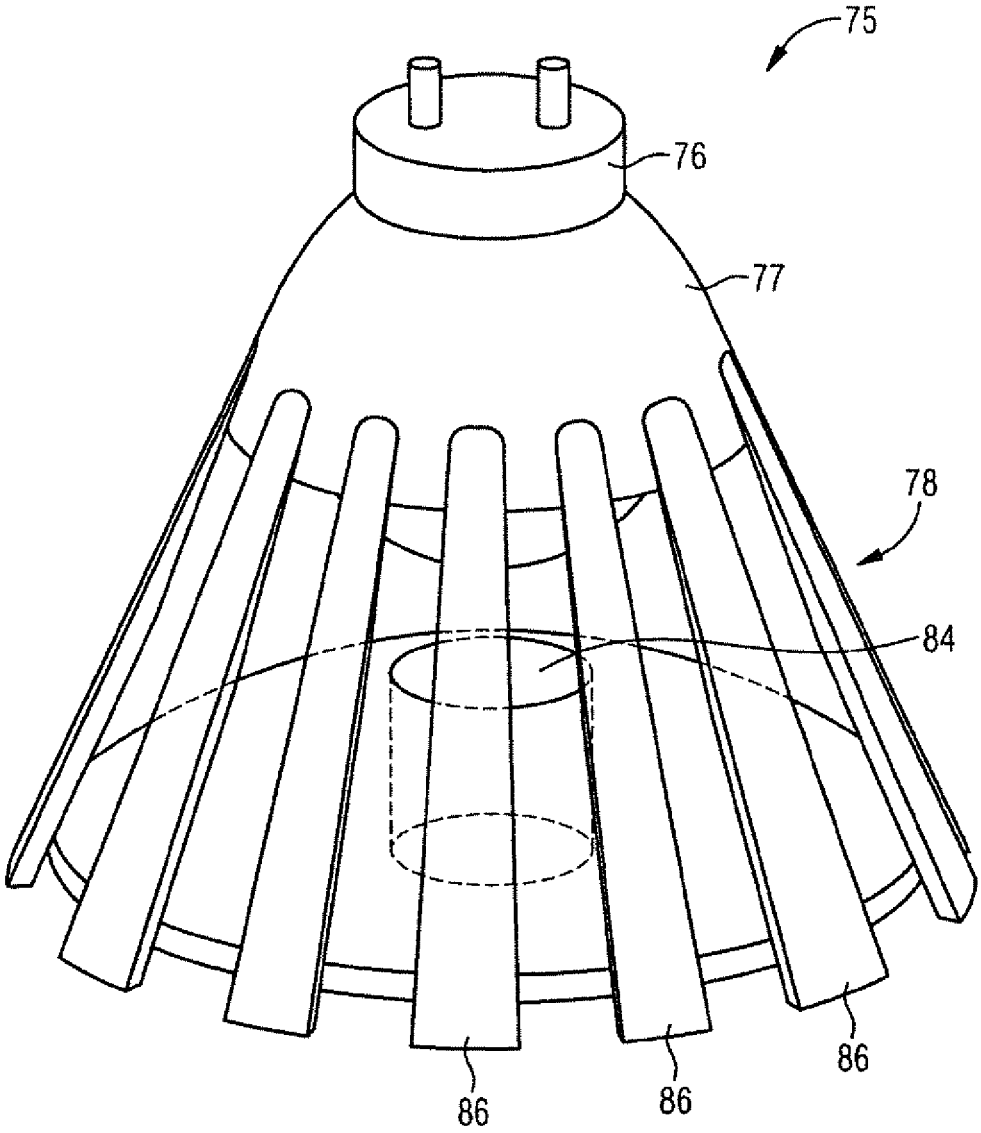
FIG. 25 shows a perspective representation of the embodiment shown in FIG. 22.

FIG. 22 shows a section through a retrofit lamp 75 which is designed as a replacement for a reflector lamp. A perspective representation of the retrofit lamp 75 is shown in FIG. 25. The retrofit lamp 75 comprises a GU10 base 76, a housing 77, a cooling element 78 and also a plate 24 holding LEDs 25. The LEDs 25 are provided with an optical system 79 and are arranged behind a cover disk 80 in a recess 81 of the cooling element 78. The cover disk 80 has at its center a ventilation opening 82 which is connected by way of a ventilation duct 83 and an opening 84 in the cooling element 78 to the recess 85 between the cooling fins 86 of the cooling element 78. This means that when the retrofit lamp 75 is installed in a perpendicular position, as shown in FIG. 22, an air flow indicated by arrows is possible which is particularly effective as a result of the chimney effect. The cooling element 78 is similar in its basic construction in particular to the cooling element 35 from FIG. 11, because the cable duct 3, not visible here, between housing 77 and plate 24 is arranged in a cooling fin 86. Similar to the housing 54 in FIG. 15, the housing 77 has a cross-section continuously reducing towards the front, which likewise results in a streamlined flow of the cooling air. The cooling fins 86 of the cooling element 78 extend forwards and finish flush with the cover disk 80.

Figure 23:
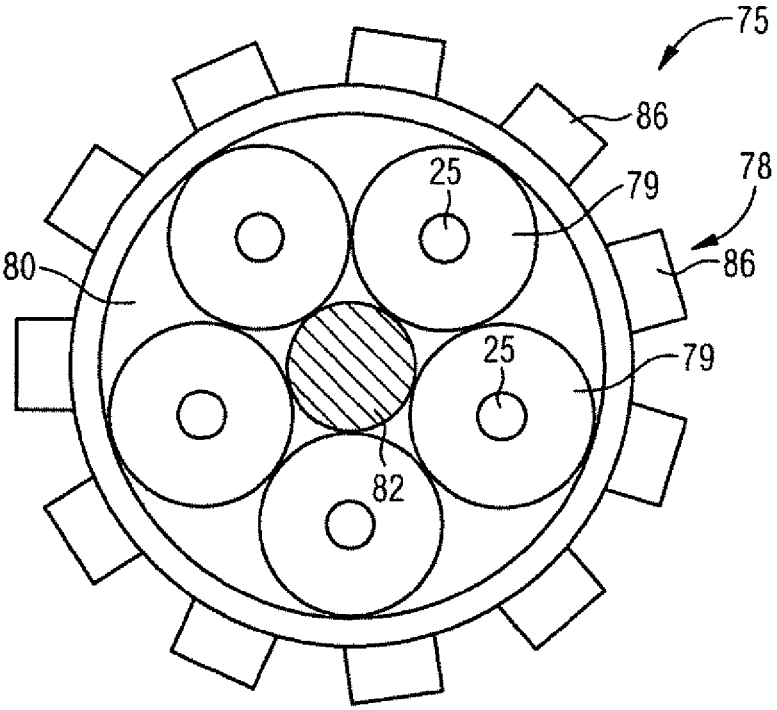
FIG. 23 shows a top view of the embodiment shown in FIG. 22.

FIG. 23 shows a top view of retrofit lamp 75 shown in FIG. 22, having the light emitting diodes 25, the optical systems 79 and the ventilation opening 82 in the cover disk 80.

Figure 24:
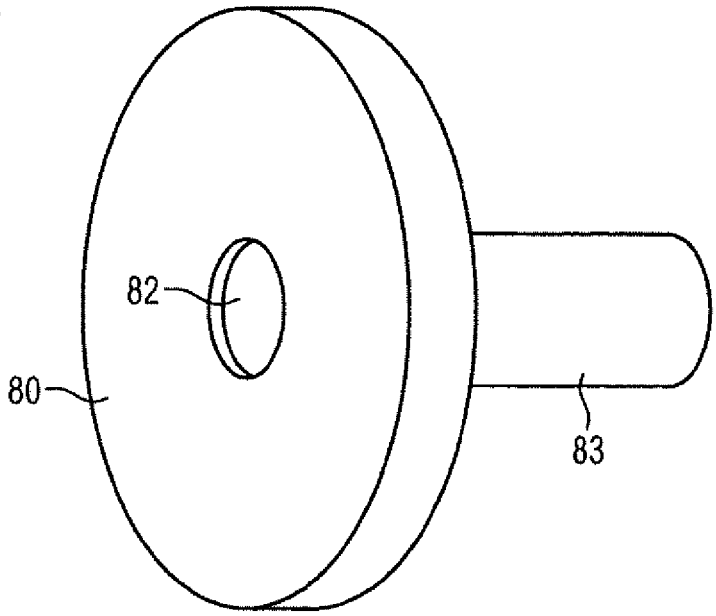
FIG. 24 shows a cover disk of the embodiment shown in FIG. 22.

As can be seen in FIG. 24, the cover disk 80 is implemented in one piece with the ventilation duct 83. This is advantageous because the production cost is thereby reduced and the centering and where applicable mounting of the cover disk 80 can be carried out in a simple manner.

Figure 26:
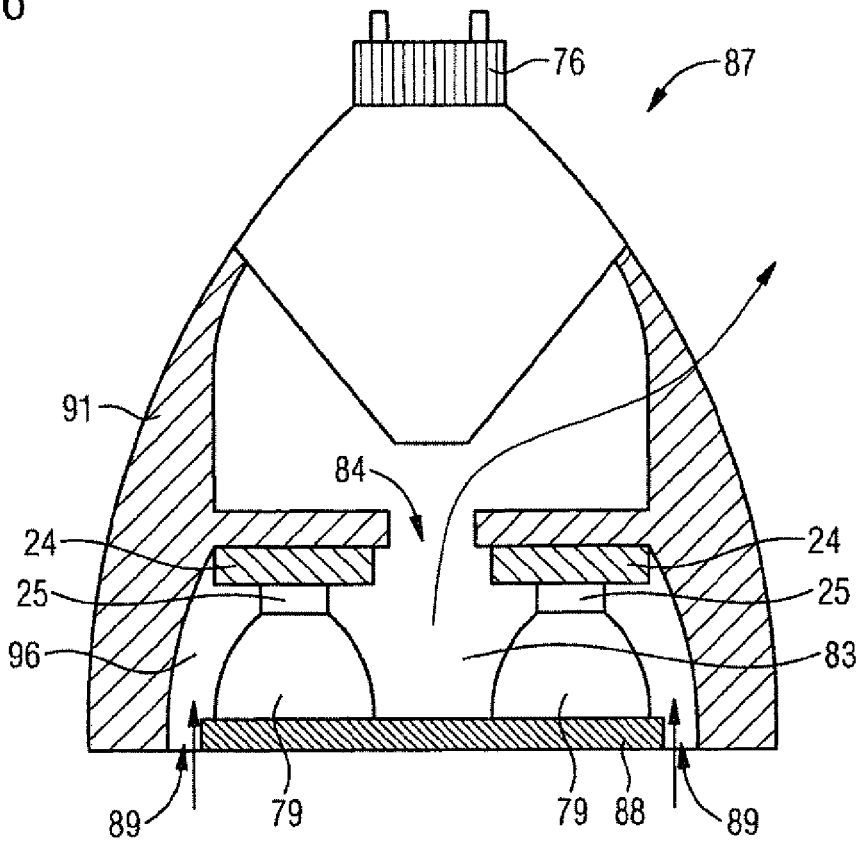
FIG. 26 shows a sectional representation of a further embodiment of the invention.

FIG. 26 shows a sectional representation of a further retrofit lamp 87, the rear part of which is designed similarly to the retrofit lamp 75 shown in FIGS. 22 to 26. In contrast to the retrofit lamp 75 from FIG. 22, however, no ventilation duct 83 from the cover disk 80 to the opening 84 of the cooling element 90 is provided here, but a cover disk 88 closed in the center is used and ventilation openings 89 are provided in the marginal region. By this means, in contrast to the preceding exemplary embodiment the cooling air also flows directly over the plate 24 and the LEDs 25, for which reason the latter can be particularly well cooled.

Figure 27:
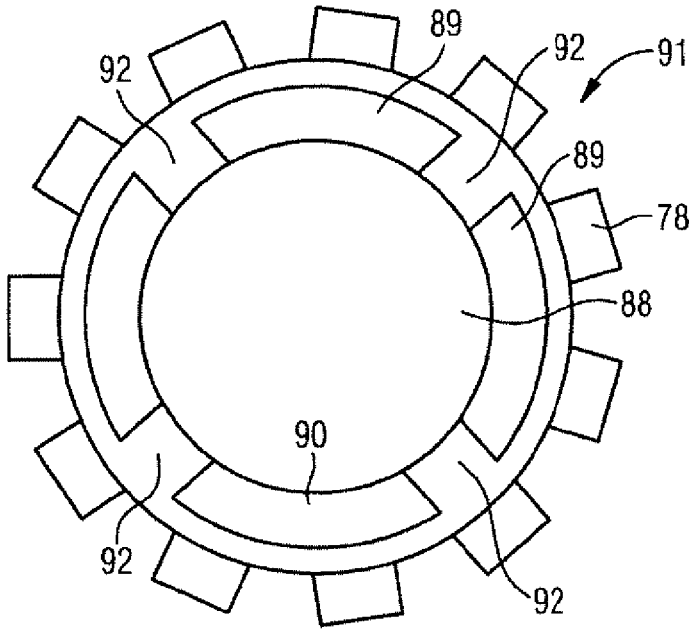
FIG. 27 shows a top view of the embodiment shown in FIG. 26.

The ventilation openings 89 can be part of the cover disk 88 itself or else, as illustrated in FIG. 27, the diameter of the cover disk 88 can be less than the diameter of the recess 90 of the cooling element 91 and the cover disk 88 will be retained by way of mountings 92.

Figure 28:
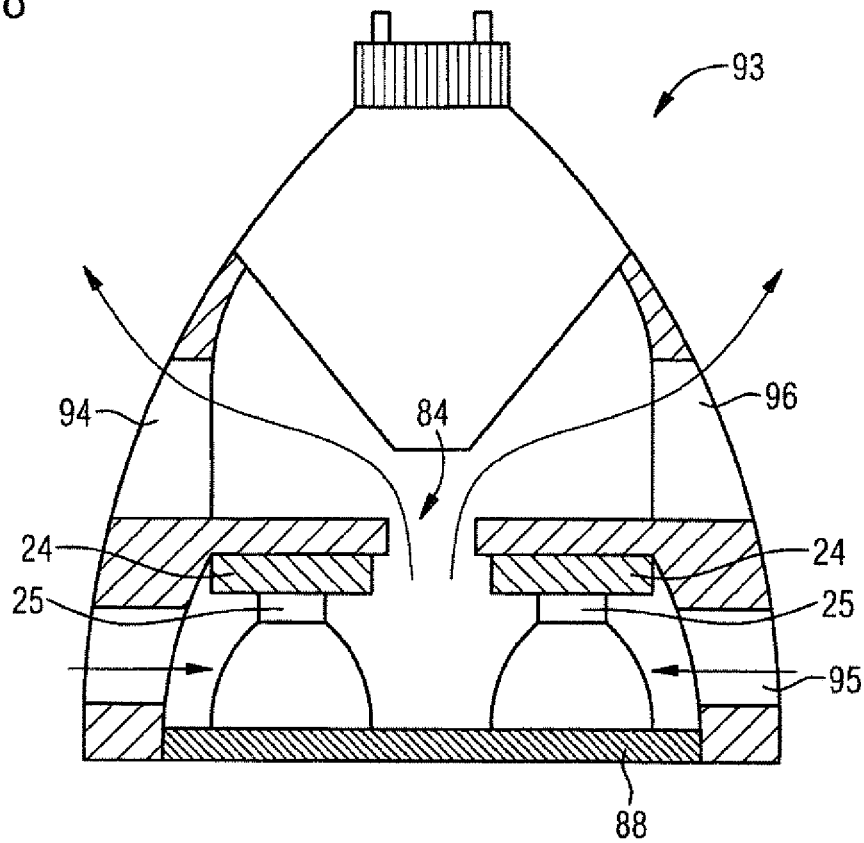
FIG. 28 shows a sectional representation of a further embodiment of the invention.
Figure 29:
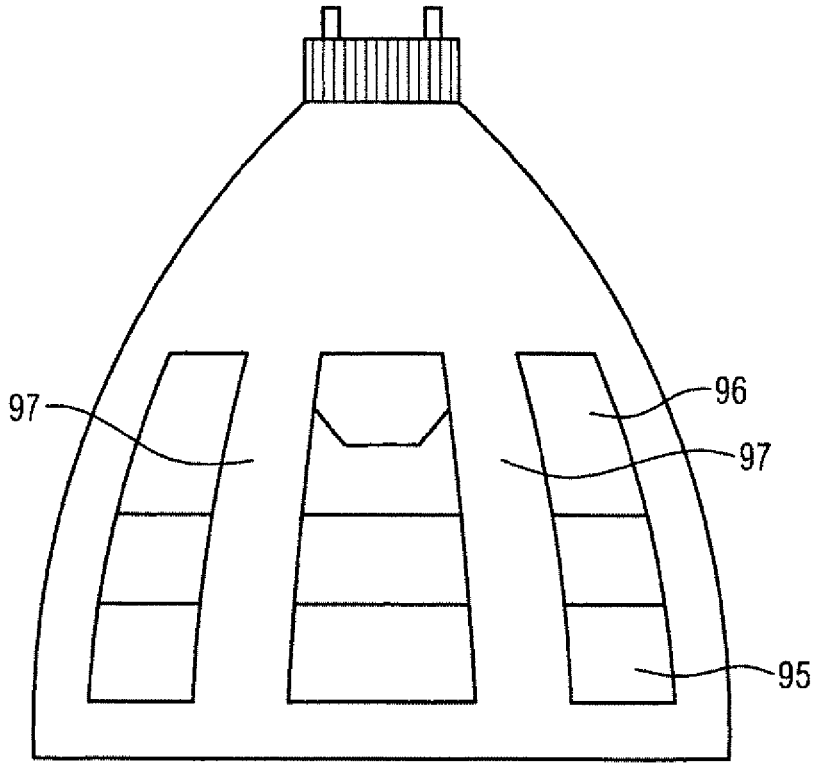
FIG. 29 shows a side view of the embodiment shown in FIG. 28.

FIG. 28 and FIG. 29 show a further embodiment of a retrofit lamp 93 which is similar to those in FIGS. 22 to 27. Here the cooling element 94 has ventilation openings 95 in the region to the side of the plate 24, through which—as indicated by means of the arrows—in particular with regard to the perpendicular installation position shown, air is sucked in by the chimney effect and after flowing through the opening 84 in the cooling element 94 is discharged again by way of the rear cooling fin intermediate spaces 96 between the cooling fins 97 of the cooling element 94. Advantageous in this situation is the fact that the air skims over the plate 24 and in contrast to the previous exemplary embodiment experiences only a simple deflection.

The present invention is naturally not restricted to the exemplary embodiments shown. Cooling fins can thus also be shaped differently, for example freely shaped. Also, the air duct for connecting at least two cooling fin intermediate spaces may contain no hollow space but may be formed for example by means of openings in the cooling fins.

In particular, the person skilled in the art will consider advantageous combinations of features stated in different exemplary embodiments. The cooling element can for example be implemented as a bent sheet metal part, as described in DE 10 2009 052 930.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE CHARACTERS

1 Cooling element
2 Housing
3 Cable duct
4 Disk-shaped part of the cooling element
5 Recess
6 Nozzle-like opening
7 Rear side of the disk-shaped part
8 Cooling fin
9 Inner edge or margin of the cooling fin
10 Outer edge or margin of the cooling fin
11 Rear edge or margin of the cooling fin
12 Hollow space
13 Cooling fin intermediate space
14 Cooling element
15 Cooling fin
16 Cooling element
17 Cooling fin
18 Cooling fin
19 Front side of the disk
20 Cooling element
21 Retrofit lamp
22 Base
23 Drive electronics module
24 Plate
25 Light emitting diode (LED)
26 Envelope
27 Cooling fins
28 Screw holes
29 Cooling element
30 Retrofit lamp
31 Through-opening
32 Cable duct
33 Ventilation opening
34 Retrofit lamp
35 Cooling element
36 Cover
37 Cooling fin
38 Retrofit lamp
39 Cooling element
40 Outside
41 Cooling fin
42 Cooling fin
43 Snap joint
44 Snap-in hooks
45 Latching element
46 Base body
47 Cap
48 Ledge
49 Snap joint
50 Latching lug
51 Snap-in edge
52 Retrofit lamp
53 Retrofit lamp
54 Housing
**54*a*** Margin
55 Cooling element
56 Cover
57 Cable duct
58 Drive electronics module
59 Cooling fin intermediate space
60 Cooling fin
61 Component
62 Component
63 Projection
64 Retrofit lamp
65 Cooling element
66 Cooling fin
67 Cooling fin
68 Retrofit lamp
69 Cooling element
70 Band
71 Cooling fin
72 Opening
73 Disk-shaped part
74 Opening
75 Retrofit lamp
76 GU10 base
77 Housing
78 Cooling element
79 Optical system
80 Cover disk
81 Recess
82 Ventilation opening
83 Ventilation duct
84 Opening
85 Recess
86 Cooling fins
87 Retrofit lamp
88 Cover disk
89 Ventilation opening
90 Recess
91 Cooling element
92 Mounting
93 Retrofit lamp
94 Cooling element
95 Ventilation opening
96 Cooling fin intermediate space
97 Cooling fin
A Section line
I Longitudinal axis
L Air flow
R Lighting device

The invention claimed is:

1. A cooling element for a lighting device to be used in a retrofit lamp comprising:

a plurality of cooling fins, wherein adjacent cooling fins in each case delimit a cooling fin intermediate space, and having at least one air duct for connecting at least two cooling fin intermediate spaces;

a double-sided disk-shaped part operatively connected on the first side to at least one cooling fin of the plurality of cooling fins, the disk-shaped part having at least one through-opening from the first side to the second side;

wherein the through-opening on the first side is between the cooling fins.

2. The cooling element as claimed in claim 1, wherein at least one of the cooling fins and the cooling fin intermediate spaces at least in sections delimit an internally situated hollow space which forms at least one part of the at least one air duct.

3. The cooling element as claimed in claim 2, wherein the cooling fins extend at least in sections along a longitudinal axis of the cooling element and around the hollow space to the outside.

4. The cooling element as claimed in claim 3, wherein the cooling fins are arranged angularly symmetrically around a longitudinal axis of the cooling element around the hollow space.

5. The cooling element as claimed in claim 2, wherein the cooling fins have free edges at least in sections laterally on both sides.

6. The cooling element as claimed in claim 5, wherein the cooling fins have free edges at least in sections on three sides.

7. The cooling element as claimed in claim 6, which is connected to a housing for a drive electronics module.

8. The cooling element as claimed in claim 7, wherein the housing for the drive electronics module is mounted at a rear end of the cooling fins.

9. The cooling element as claimed in one of claim 8, which is connected to the housing by means of a cable duct running through the hollow space.

10. The cooling element as claimed in claim 9, wherein the cable duct comprises a light-conducting material.

11. The cooling element as claimed claim 7, wherein the housing for the drive electronics module has at least one cooling fin.

12. The cooling element as claimed in claim 11, wherein at least one cooling fin of the housing for the drive electronics module is arranged between two cooling fins of the cooling element.

13. A retrofit lighting device comprising at least one cooling element, the cooling element comprising a plurality of cooling fins, wherein adjacent cooling fins in each case delimit a cooling fin intermediate space, and having at least one air duct for connecting at least two cooling fin intermediate spaces; the light device further comprising a double-sided disk-shaped part operatively connected on the first side to at least one cooling fin of the plurality of cooling fins, the disk-shaped part having at least one through-opening from the first side to the second side;

wherein the through-opening on the first side is between the cooling fins.

14. The lighting device as claimed in claim 13, wherein the cooling element is thermally coupled to at least one semiconductor light source.

15. The lighting device as claimed in claim 14, wherein the housing for the drive electronics module has a cross-section which reduces towards the front.

16. The lighting device as claimed in claim 15, wherein the housing for the drive electronics module merges continuously into a cable duct.

* * * * *